US011456553B2

(12) United States Patent
Soh et al.

(10) Patent No.: US 11,456,553 B2
(45) Date of Patent: Sep. 27, 2022

(54) LOW PROFILE HIGH VOLTAGE CONNECTOR AND METHOD FOR ASSEMBLYING THEREOF

(71) Applicant: J.S.T. CORPORATION, Farmington Hills, MI (US)

(72) Inventors: Hua Sheng Soh, Bukit Batok (SG); Minguang Eu, Woodland (SG); Gweldolyn Upson, Ypsilanti, MI (US); Kurt Hutchison, Farmington Hills, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 17/025,202

(22) Filed: Sep. 18, 2020

(65) Prior Publication Data

US 2021/0091501 A1 Mar. 25, 2021

Related U.S. Application Data

(60) Provisional application No. 62/902,867, filed on Sep. 19, 2019.

(51) Int. Cl.
*H01R 13/436* (2006.01)
*H01R 43/20* (2006.01)
(Continued)

(52) U.S. Cl.
CPC ..... *H01R 13/4361* (2013.01); *H01R 12/75* (2013.01); *H01R 13/639* (2013.01); *H01R 43/20* (2013.01); *H01R 43/26* (2013.01)

(58) Field of Classification Search
CPC ..... H01R 13/6272; H01R 13/4361; H01R 13/639
(Continued)

(56) References Cited

U.S. PATENT DOCUMENTS 4,946,395 A * 8/1990 Cope ..... H01R 13/6272 439/352
4,946,399 A * 8/1990 Kawashima ..... H01R 13/436 439/752
(Continued)

*Primary Examiner* — Neil Abrams
(74) *Attorney, Agent, or Firm* — Kratz, Quintos & Hanson, LLP

(57) ABSTRACT

A low profile high voltage connector, having a minimal height and meeting high voltage requirements and a method of assembling thereof, includes a male housing and a female housing, and further includes a terminal position assurance (TPA) device and a connector position assurance (CPA) device, the TPA device ensuring that a terminal, housed within the female housing, provides a secondary lock, so as to ensure that the terminal is secured or locked within the female housing. The CPA device assures that the male and female housings remain locked and inseparable from each other. The terminal is housed within the female housing in such a way as to have the female housing, engaged within the male housing, to meet a minimal height requirement. Each of the TPA device and the CPA device functions in a pre-lock position or a full-lock position when engaging with the low profile high voltage connector. The method also improves clearance and creepage in the low profile high voltage connector by allowing the clearance or electrical path to extend from at least an electrical wire or cable to the female housing.

14 Claims, 22 Drawing Sheets

(51) Int. Cl.
*H01R 13/639* (2006.01)
*H01R 12/75* (2011.01)
*H01R 43/26* (2006.01)

(58) Field of Classification Search
USPC ..... 439/752
See application file for complete search history.

(56) References Cited

U.S. PATENT DOCUMENTS 4,979,913 A * 12/1990 Aiello ..... H01R 13/422 439/596
5,122,080 A * 6/1992 Hatagishi ..... H01R 13/4362 439/595
5,342,223 A * 8/1994 Geib ..... H01R 13/4362 439/752
5,928,038 A * 7/1999 Berg ..... H01R 13/6272 439/752
6,066,008 A * 5/2000 Brantingham ..... H01R 13/4362 439/595
6,139,375 A * 10/2000 Konoya ..... H01R 13/4361 439/752
6,334,783 B1 * 1/2002 Hu ..... H01R 13/4367 439/84
6,824,417 B1 * 11/2004 Nimura ..... H01R 13/641 439/352
7,052,317 B2 * 5/2006 Hara ..... H01R 12/7029 439/567
7,066,773 B1 * 6/2006 Martin ..... H01R 13/4365 439/752
7,195,522 B2 * 3/2007 Okada ..... H01R 13/4362 439/752
7,559,808 B2 * 7/2009 Nishide ..... H01R 13/4362 439/733.1
7,811,139 B1 * 10/2010 Parikh ..... H01R 13/508 439/752
8,016,606 B1 * 9/2011 Kwan ..... H01R 13/641 439/352
8,137,142 B1 * 3/2012 Dawson ..... H01R 13/639 439/676
9,680,256 B1 * 6/2017 Lane ..... H01R 13/6275
10,454,209 B2 * 10/2019 Holub ..... H01R 43/26
10,811,819 B2 * 10/2020 Azad ..... H01R 13/64
11,233,345 B2 * 1/2022 Gross ..... H01R 12/7023
2021/0091501 A1 * 3/2021 Sheng ..... H01R 13/4361
2021/0091502 A1 * 3/2021 Sheng ..... H01R 13/639

* cited by examiner

LOW PROFILE HIGH VOLTAGE CONNECTOR AND METHOD FOR ASSEMBLYING THEREOF

CROSS-REFERENCE TO RELATED APPLICATION

This patent application claims priority to U.S. Provisional Patent Application No. 62/902,867 filed Sep. 19, 2019, which is hereby incorporated herein by reference in its entirety.

This patent application is related to co-pending U.S. patent application Ser. No. 17/027,577 filed on Sep. 21, 2020 or U.S. Patent Application Publication No, US2021-0091502-A1 published on Mar. 25, 2021.

BACKGROUND OF THE INVENTION

It is desired that a high voltage connector be provided with a minimal height and meets high voltage requirements. The minimal height, high voltage connector of this invention includes a male housing and a female housing, and further includes a terminal position assurance (TPA) device and a connector position assurance (CPA) device. The TPA device, when in a full-lock position, assures that a terminal, residing within the female housing, is secured or locked within the female housing. The CPA device, when in a full-lock position, assures that the male and female housings remain engaged or locked together. The orientation of terminals within the female housing allows for a low profile, and the TPA device of the present invention locks on the sides of the female housing which further provides for a low profile. Each of the TPA device and the CPA device functions in, and is movable to, a pre-lock position or a full-lock position. The TPA member of the present invention also has wall members which assist in increasing the creepage and clearance of the terminal high voltage connector between adjacent terminals. The female housing and male housings lock and mate wherein the pins of the male housing insert into apertures of the female housing and are accommodated into respective terminals inside the female housing when the male housing and female housing are assembled and locked.

The female housing has openings which accommodate and are of a polarity or shape that fit the terminal of the present invention therein, and provides proper subsequent locking with the terminal, see for example, U.S. Nonprovisional patent application Ser. No. 16/042,247, entitled "AN ELECTRICAL FEMALE TERMINAL", Chen et al. filed on Jun. 17, 2020, which discloses a polarity of a female terminal having an orientation or polarity which is maintained and ensured for proper fitment into a corresponding connector assembly. The connector assembly having an opening with a similar orientation or similar polarity which is also maintained for proper fitting with the electrical female terminal.

SUMMARY OF THE INVENTION

This invention provides a high voltage connector that has a minimal height and meets high voltage requirements. The high voltage connector of this invention includes a male housing and a female housing. The orientation of terminals within the female housing allows for a low profile, and the TPA device of the present invention locks on the sides of the female housing which further provides for a low profile. The high voltage connector may attach to a printed circuit board (PCB) by using metallic retention tabs attached to the male housing. Preferably, eight pins attach to a back end of the male housing and protrude through openings thereof and into spaces of the male housing where they reside. The female housing, at a back end respectively receives a plurality of terminals (preferably, eight terminals) with respective wires or cables attached thereto. The front end of the male housing has a front opening which leads to a cavity both of which are shaped and sized to receive the female housing.

It is important that the polarity of the terminal and the polarity of the openings of the female housing, which receive the terminals, are corresponding. The terminal is oriented upon entry into the female housing opening such that the lever member of the terminal will reside in a terminal lock cavity in the female housing and a space of the terminal will be aligned with an aperture of the female housing. More specifically, the terminals are accommodated in the female housing in front protruding receptacle members and in the terminal lock cavity and the terminal cavity respectively. Each receptacle member has two apertures at the front end portion of the female housing. One aperture is located where the terminal cavity meets the front end portion of the female housing for accommodating a pin of the male housing. A second aperture is located where the terminal lock cavity meets the front end portion of the female housing and is available to accommodate a tool to interact with the terminal.

Each of the terminals is inserted into the female housing, at the back end thereof, and the terminal may block a pre-lock TPA device from being movable into a full-lock position, and therefore, the TPA device is not movable or able to be pushed through an aperture of the female housing into a space provided in the terminal, into the terminal cavity (TPA device remains in a pre-lock position). The TPA device is therefore prevented from moving into the space of the terminal and further locking the position of the terminal in the female housing as a secondary lock feature. When the TPA device is in a pre-lock position, ends of the TPA device lock or engage at respective side portions of the female housing and the TPA device can remain attached to the female housing and at a pre-lock position.

When the terminal is completely pushed into, or fully inserted into the female housing, a lever member of the terminal extends into the terminal lock cavity and the terminal is locked in the female housing and unable to be removed. An aperture at the end of each receptacle member is aligned with the terminal lock cavity such that a tool may be inserted to press the lever member and unlock the terminal. Additionally, when the terminal is fully inserted and locked in the female housing, the space within the terminal is aligned to the aperture in the female housing, allowing the TPA device to be fully inserted into the female housing and move into a full-lock position, thereby allowing the ends of the TPA device to be in full-lock or full engagement with respective side portions of the female housing. At full-lock, a wall of the TPA blocks the movement of the terminal, and thereby acts as a secondary lock for the terminal by assuring the terminal remains in the lock position within the female housing.

The high voltage connector of the present invention further includes a connector position assurance (CPA) device. The CPA device includes a centrally located flexible member, a front end of the centrally located flexible member of the CPA having a ramp-like shaped lock member. A centrally located lock member of the male housing adjacent to the opening and in the cavity of the male housing inclines in a downward direction from the front to the back of the male housing respectively. The female housing includes a pair of centrally located flexible members which act as a lever and have a ramp-like central lock member located and connected between. The central lock member of the female housing inclines in an upward direction from the front to the back of the female housing respectively. The pair of centrally located flexible members are attached to a portion of the female housing toward a front end portion thereof, and at the back end they freely movable and are connected to a joint member.

When the female housing, having a CPA device at a pre-lock position, is inserted into the male housing, the centrally located lock member of the male housing traverses over and lowers the inclined central lock member of the female housing along an upper portion, until such time as the lock member of the male housing continues its travel and onto the lock member of the CPA device. At this point, the male housing and female housing are fully mated and locked together and are unable to be separated unless the centrally located flexible members of the female housing are depressed at a joint member thereof. When the CPA device is in a full-lock position, the centrally located lock member of the male housing rests behind the inclined central lock member of the female housing and the lock member of the CPA device rests on an opposite side of the central lock member of the female housing from where it resided in a pre-lock position. A portion of the CPA device under the centrally located flexible members of the female housing prevents them from being moved downward, assuring the free end of the flexible members will not move and unlock female housing from the male housing.

Also, when the male housing mates with the female housing, the pins of the male housing enter an aperture of the female housing at the front end portion of the female housing. The pins are aligned with the apertures of the female housing such that the pins enter into the corresponding terminal residing in the receptacle member of the female housing.

Also, with the above-described structural arrangements of this invention, "creepage" (a measurement of the shortest path along the surface from any given circuit in a connector to any (usually adjacent) other circuit, and "clearance" (defined as, e.g., a measurement of the shortest electrical path from any exposed electrically conducting element in a given circuit of a connector to any other electrically conducting element in a different circuit in the same connector) are advantageously increased, thereby modifying or influencing the electrical path comprised of or of an associated shorting current when the low profile high voltage connector assembly of this invention is in operation or in use. The TPA member of the present invention also has wall members which assist in increasing the creepage and clearance of the high voltage connector between the adjacent terminals therein.

BRIEF DESCRIPTION OF THE DRAWINGS

FIG. 6A is a bottom perspective view of the TPA device of this invention, while

FIG. 7A is a bottom perspective view of the female housing with terminals residing in the terminal cavities, and shows the apertures for receiving the TPA device and protruding members extending from the sides thereof for locking the TPA device, while

FIG. 8A is a bottom perspective view of the female housing with terminals residing in the terminal cavities, and shows the TPA device therein in a pre-lock position, while

FIG. 9A is a bottom perspective view of the female housing with terminals residing in the terminal cavities, showing the TPA device therein in a full-lock position, while

FIG. 10A is a cross-sectional view, taken along line 10A-10A of FIG. 3, of a terminal having a wire or cable, the terminal being partially inserted into the female housing and further showing the TPA device in a pre-lock position, while

FIG. 14A is a cross-sectional view of the low profile high voltage connector of this invention, taken along line 14A-14A of FIG. 2, showing the CPA device in a pre-lock position, while

DETAILED DESCRIPTION OF THE PREFERRED EMBODIMENTS

Figure 1A:
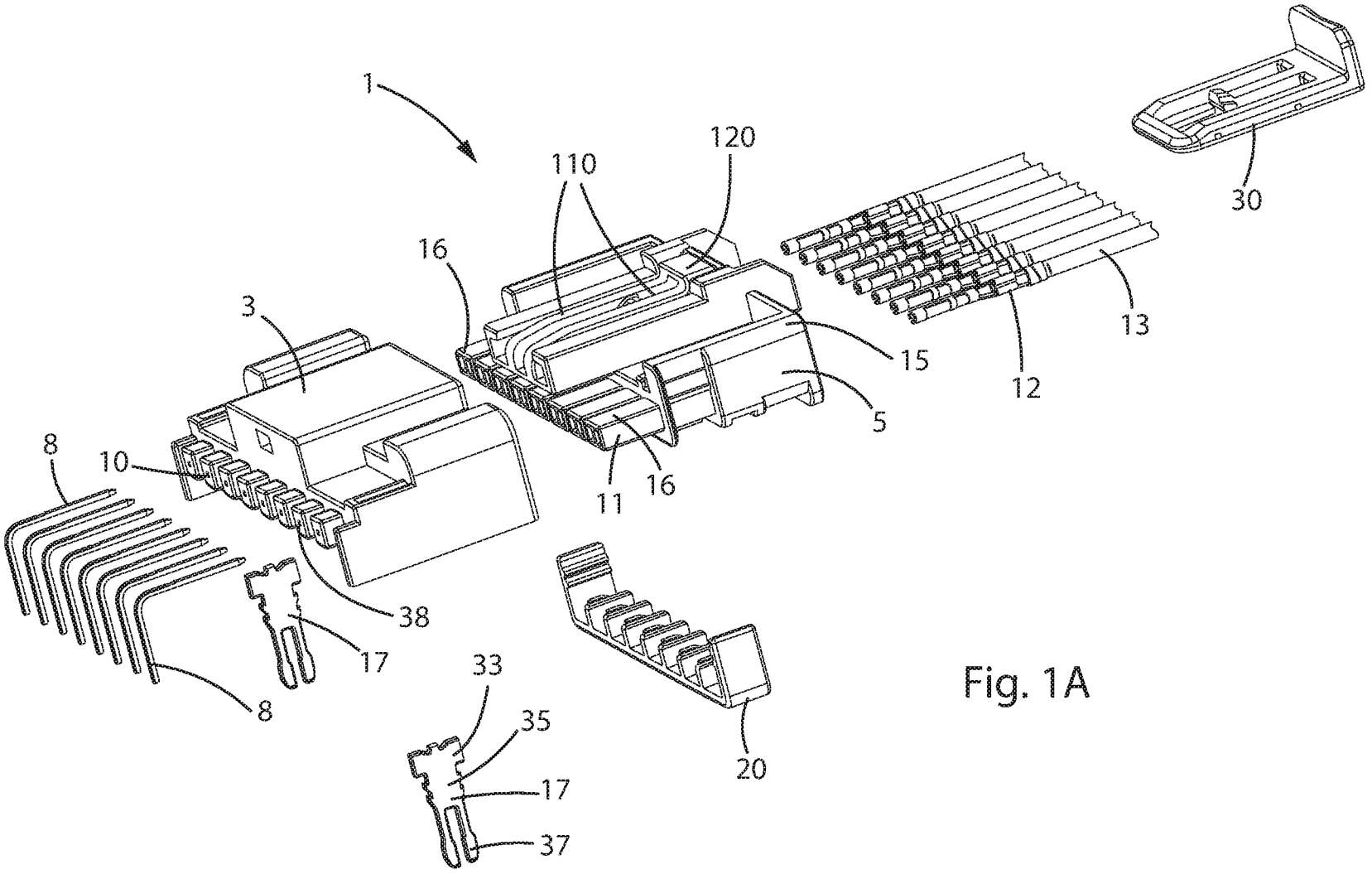
FIG. 1A is a left perspective exploded view of the low profile high voltage connector of this invention.

FIG. 1A shows a left perspective exploded view of a low profile high voltage connector, generally referred to as reference number 1, of this invention. The low profile high voltage connector 1 is provided with a minimal height and meets high voltage requirements. The low profile high voltage connector 1 includes a male housing 3 and a female housing 5. The orientation of terminals 12 within the female housing 5 allows for a low profile, as well as a terminal position assurance (TPA) device 20 of the present invention which locks on side portions 83 of the female housing 5. Additionally, a plurality of pins 8 (preferably, eight in this case) respectively inserted into openings 38 in a back end portion 10 of the male housing 3 and into a space 100 of the male housing 3 where they reside. A plurality of terminals 12 (preferably, eight terminals) are respectively inserted into openings 48 in a back end portion 15 of the female housing 5, each of the terminals 12 having a respective wire or cable 13 attached thereto. The front end portion 11 of the female housing 5 includes a plurality of receptacle members 16 for respectively accommodating therein the terminals 12.

Also shown in FIG. 1A are metallic on tabs 17, hick allow the low profile high voltage connector 1 to be mounted or affixed onto a printed circuit board (PCB) (not shown). Also shown, is the terminal position assurance (TPA) device 20, which assures the locking of the terminals 12 inside the female housing 5, and a connector position assurance (CPA) device 30, which assures the locking of the male housing 3 with the female housing 5.

Figure 1B:
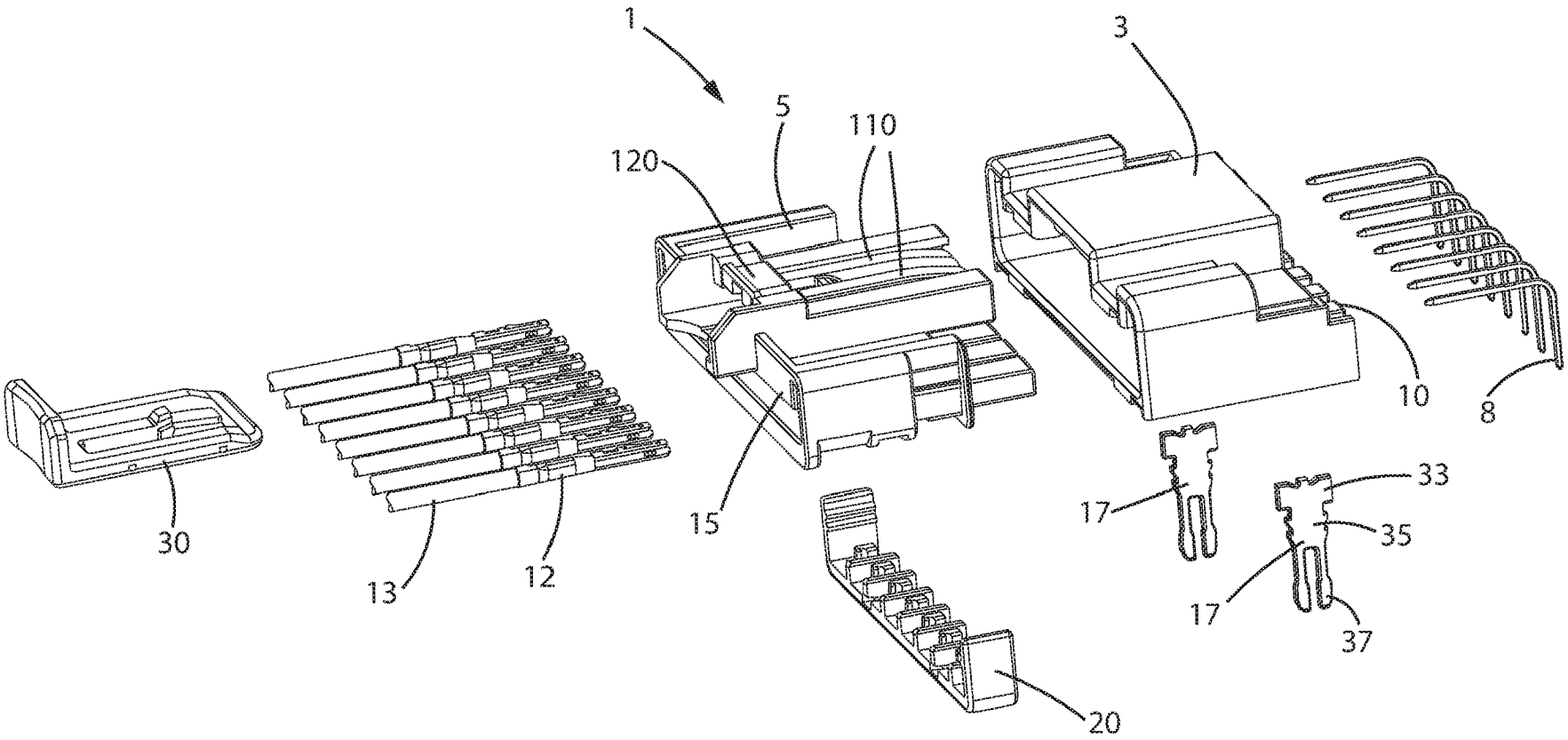
FIG. 1B is a right perspective exploded view of the low profile high voltage connector of this invention

FIG. 1B shows a right perspective exploded view of the low profile high voltage connector 1 of this invention similarly illustrating all the parts (the male housing 3, the female housing 5, the plurality of pins 8, the plurality of terminals 12, the metallic retention tabs 17, the TPA device 20, and the CPA device 30), as described above in FIG. 1A. Each of the metallic retention tabs 17 includes a pair of upper wing-like members 33, a barb-like portion 35, and a pair of lower compliant members 37 (See, also FIG. 1A).

Figure 2:
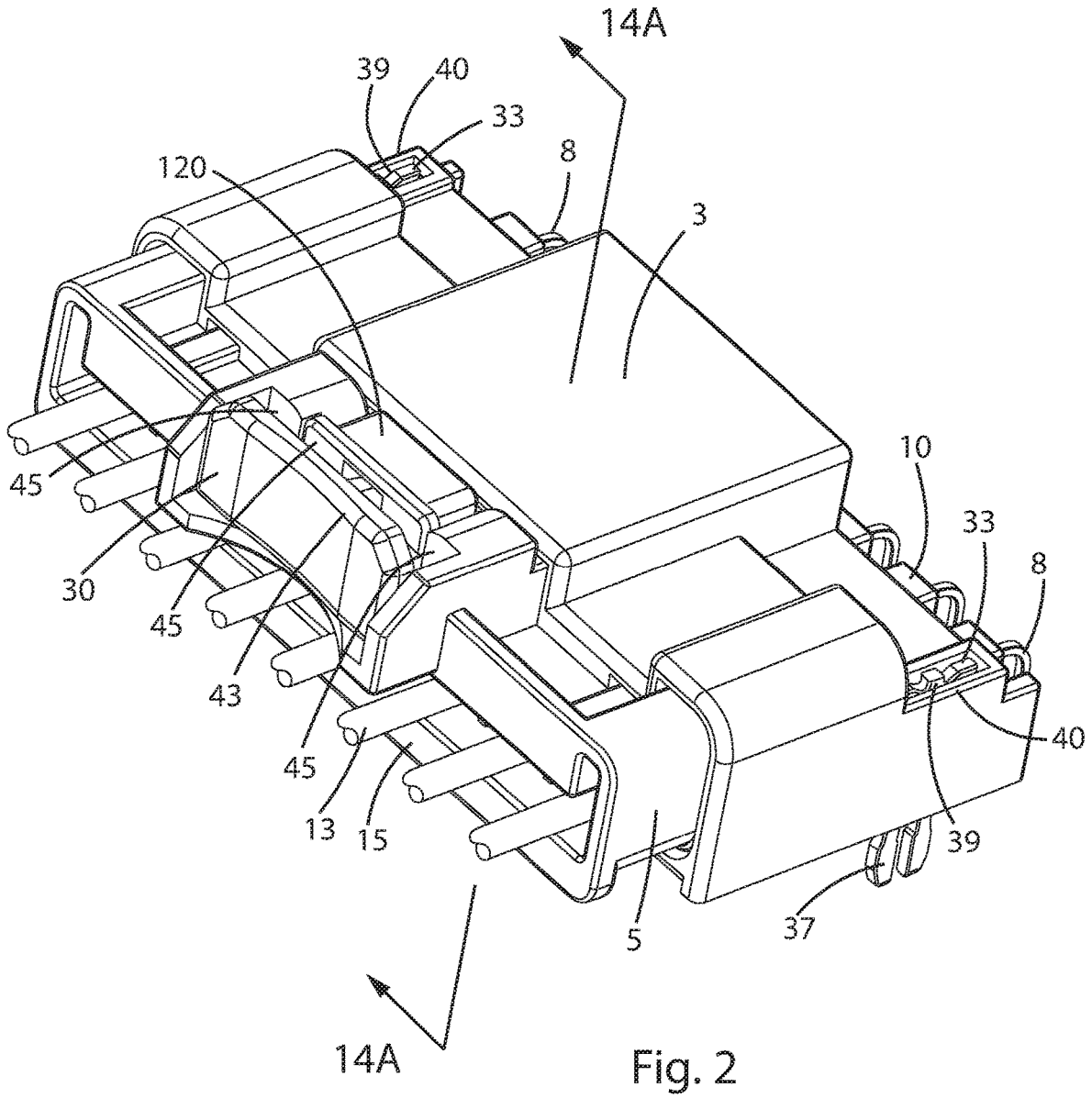
FIG. 2 is a right perspective view of a fully assembled low profile high voltage connector of this invention with the CPA device in a pre-lock position.

FIG. 2 is a right perspective view of a fully assembled low profile high voltage connector 1 of this invention with the CPA device 30 in a pre-lock position. Also shown are the plurality of pins 8, respectively inserted into the male housing 3, as well as the plurality of terminals 12 inserted into the female housing 5. Respectively secured inside an aperture 39 in each of the side portions 40 of the male housing 3 is each one of the pair of metallic retention tabs 17, respectively. The metallic retention tabs 17 are each secured by engaging with the inside of their respective apertures 39 by the pair of upper wing-like members 33 and corresponding barb-like portion 35. Each of the pair of lower compliant members 37 of the metallic retention tab 17 extends from the male housing 3 through and from the aperture 39 and protrudes beneath a corresponding one of the side portions 40 and in condition to be affixed into the PCB (not shown). In FIG. 2, the CPA device 30 is in a pre-lock position with its head member 43 toward the back end portion 15 of the female housing 5 and having a distance away from and not contacting a pair of center back portions 45 of the female housing 5, the center back portions 45 being on each side of flexible centrally located flexible members 110 of the female housing 5. As will be discussed later, the CPA device 30 is prevented from being fully removable from the female housing 5 by the ramp member 155 of the female housing 5 which blocks the front member 140 of the CPA device 30 and prevents the CPA device 30 from being removable from the back end portion 15 of the female housing 5 (See, FIGS. 14A, 14B).

Figure 3:
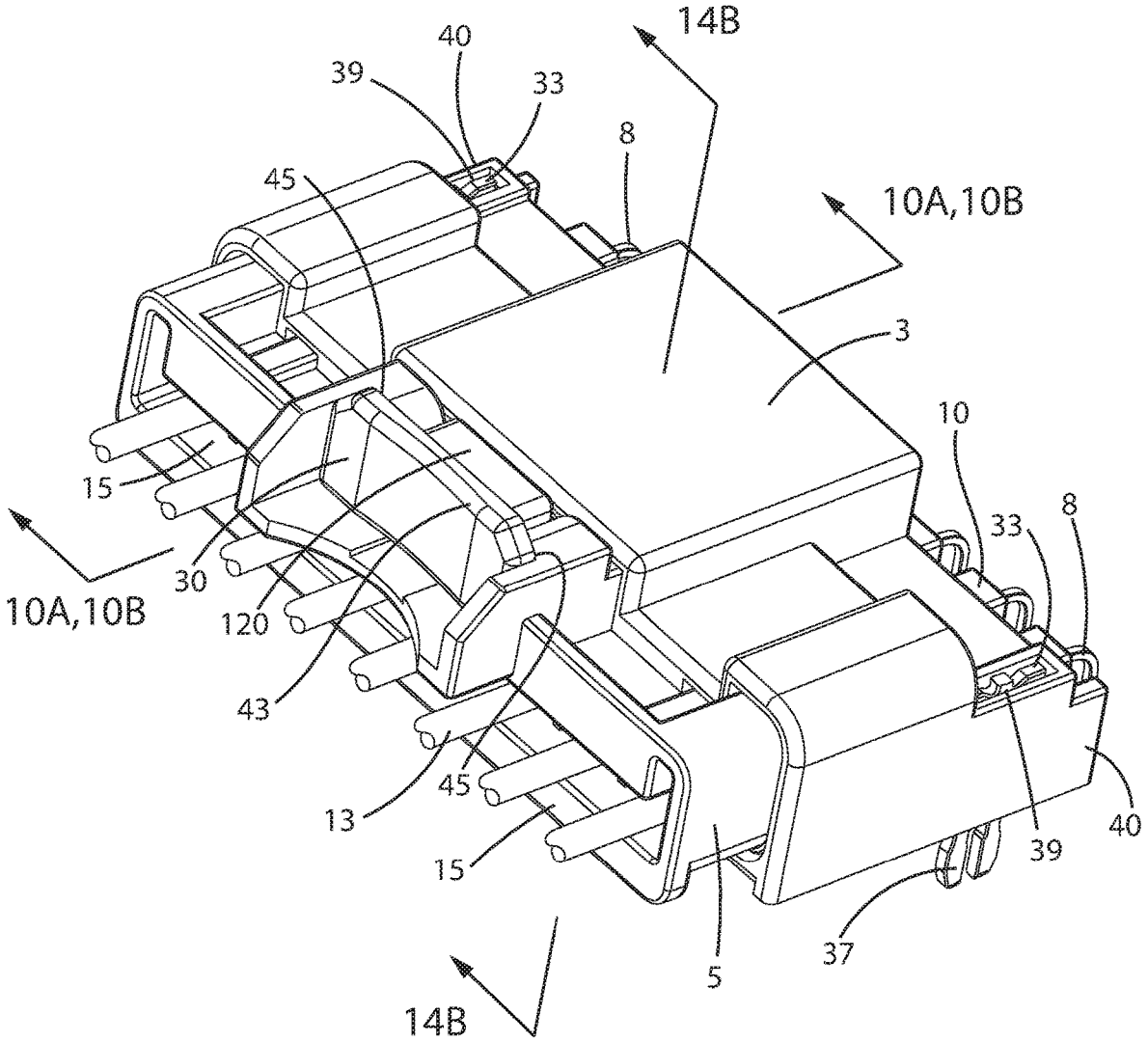
FIG. 3 is a right perspective view of the fully assembled low profile high voltage connector of this invention with the CPA device in a full-lock position.

FIG. 3 is a right perspective view of the fully assembled low profile high voltage connector 1 of this invention with the CPA device 30 in a fill-lock position. Other than the CPA device 30, being at a full-lock position, being fully pushed and inserted into the female housing 5 so as to have the head member 43 of the CPA device 30 contact the center back portions 45 of the female housing 5, all the parts of the fully assembled low profile high voltage connector 1 of this invention are similar to those shown and described above with respect to FIG. 2.

Figure 4:
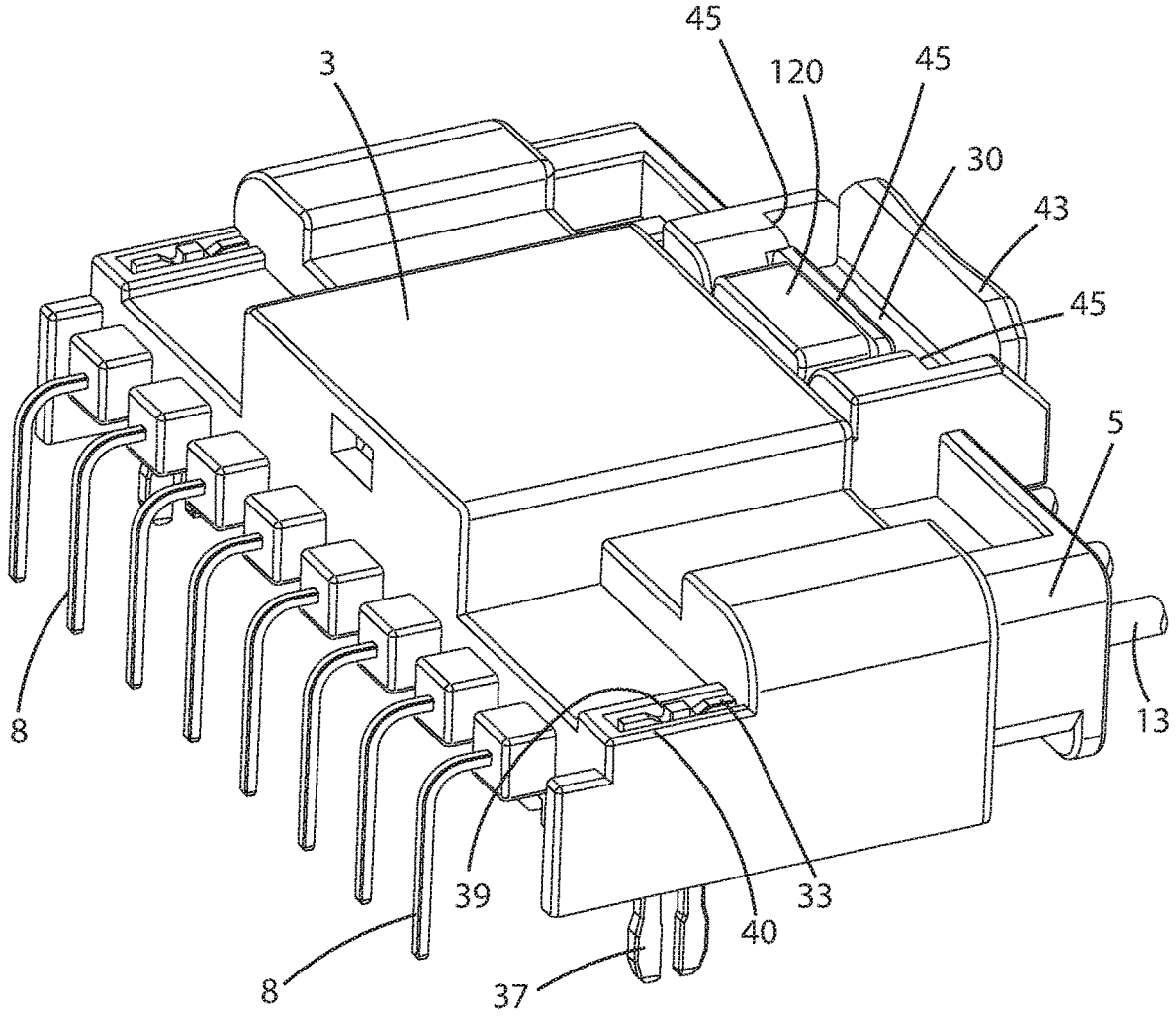
FIG. 4 is a left perspective view of the fully assembled low profile high voltage connector of this invention with the CPA device in a pre-lock position.

FIG. 4 is a left perspective view of the fully assembled low profile high voltage connector 1 of this invention with the CPA device 30 in the pre-lock position. Shown respectively inserted into the male housing 3 are the plurality of pins 8, and respectively inserted into the female housing 5 are the plurality of terminals 12 (See, FIG. 14B). As previously mentioned with respect to FIG. 2, secured inside each of side portions 40 of the male housing 3 is one of the pair of upper wing-like members 33 and corresponding barb-like portion 35 of the metallic retention tab 17. Each of the pair of lower compliant members 37 of the metallic retention tab 17 extends from beneath the corresponding one of the side portions 40 of the male housing 3 ready to be affixed into the PCB (not shown). Further in FIG. 4, the CPA 30 is in a pre-lock position with its head member 43 away from and not contacting the center back portions 45 of the female housing 5.

Figure 5:
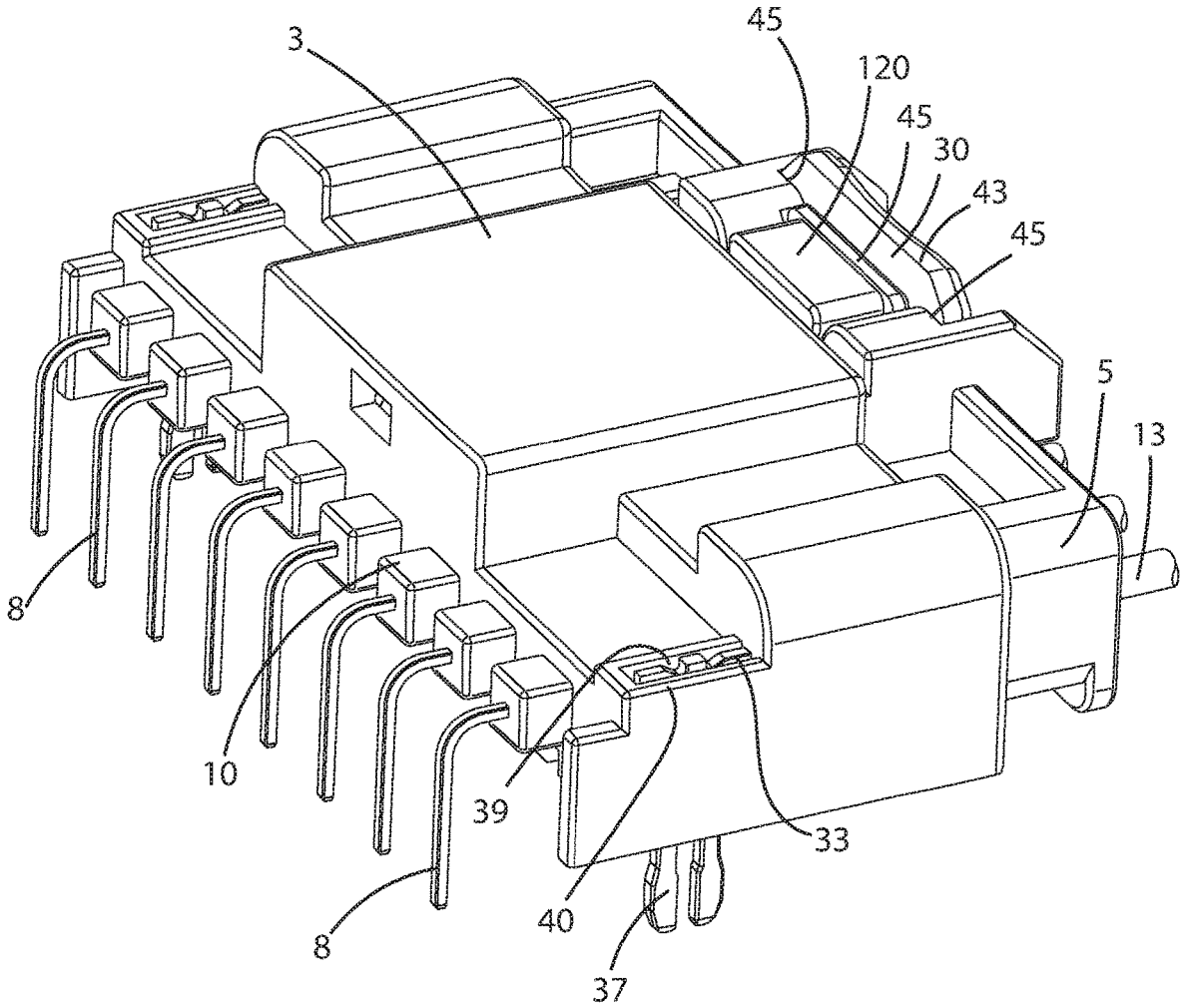
FIG. 5 is a left perspective view of the fully assembled low profile high voltage connector of this invention with the CPA device in a full-lock position.

FIG. 5 is similarly a left perspective view of the fully assembled low profile high voltage connector 1 of this invention with the CPA device 30, in this FIG. 5, in a fill-lock position. Other than the CPA 30, at a full-lock position, being fully pushed and inserted into the female housing 5 so as to have the head member 43 of the CPA device 30 contact the center back portions 45 of the female housing 5, all the parts of the fully assembled low profile high voltage connector 1 of this invention are similar to those shown and described above with respect to FIG. 4.

Figure 6A:
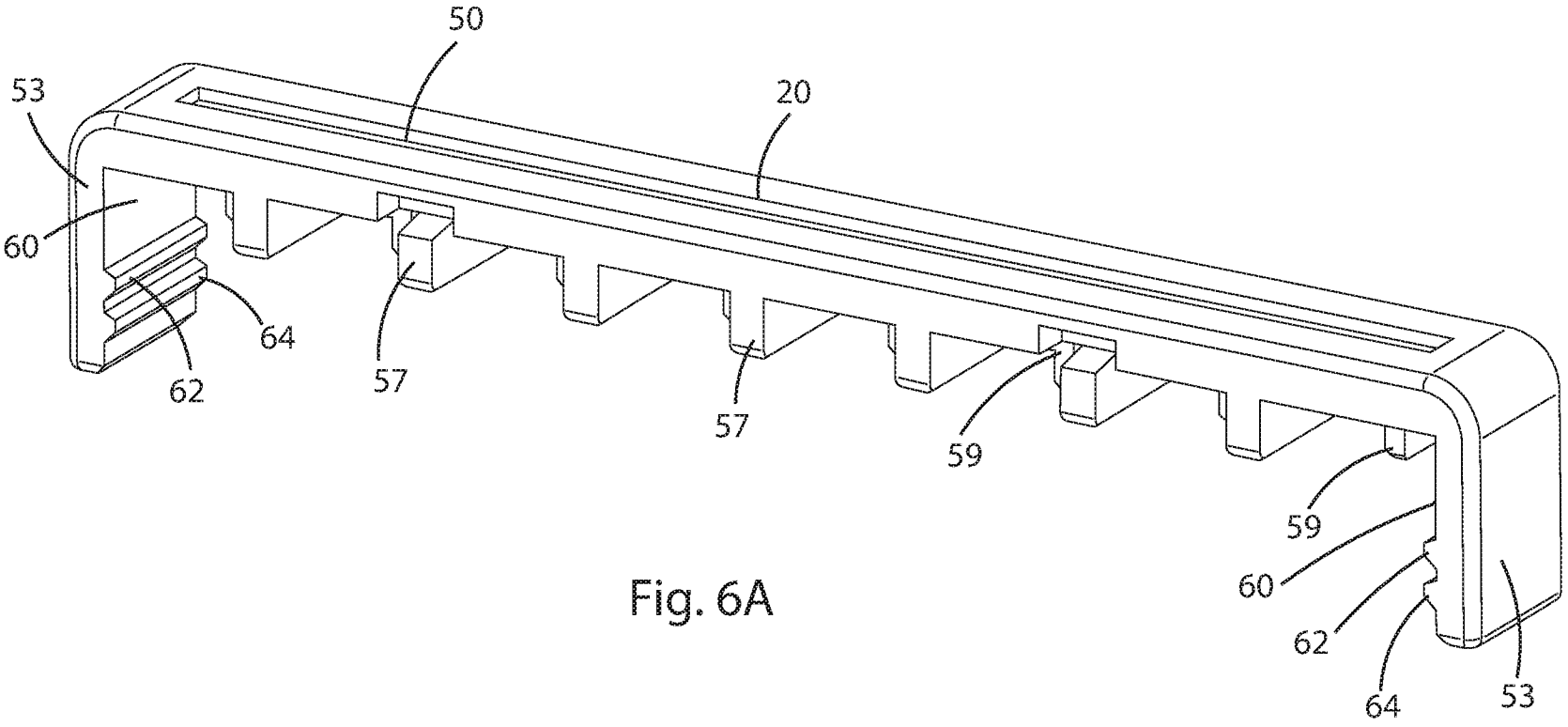
Figure 6B:
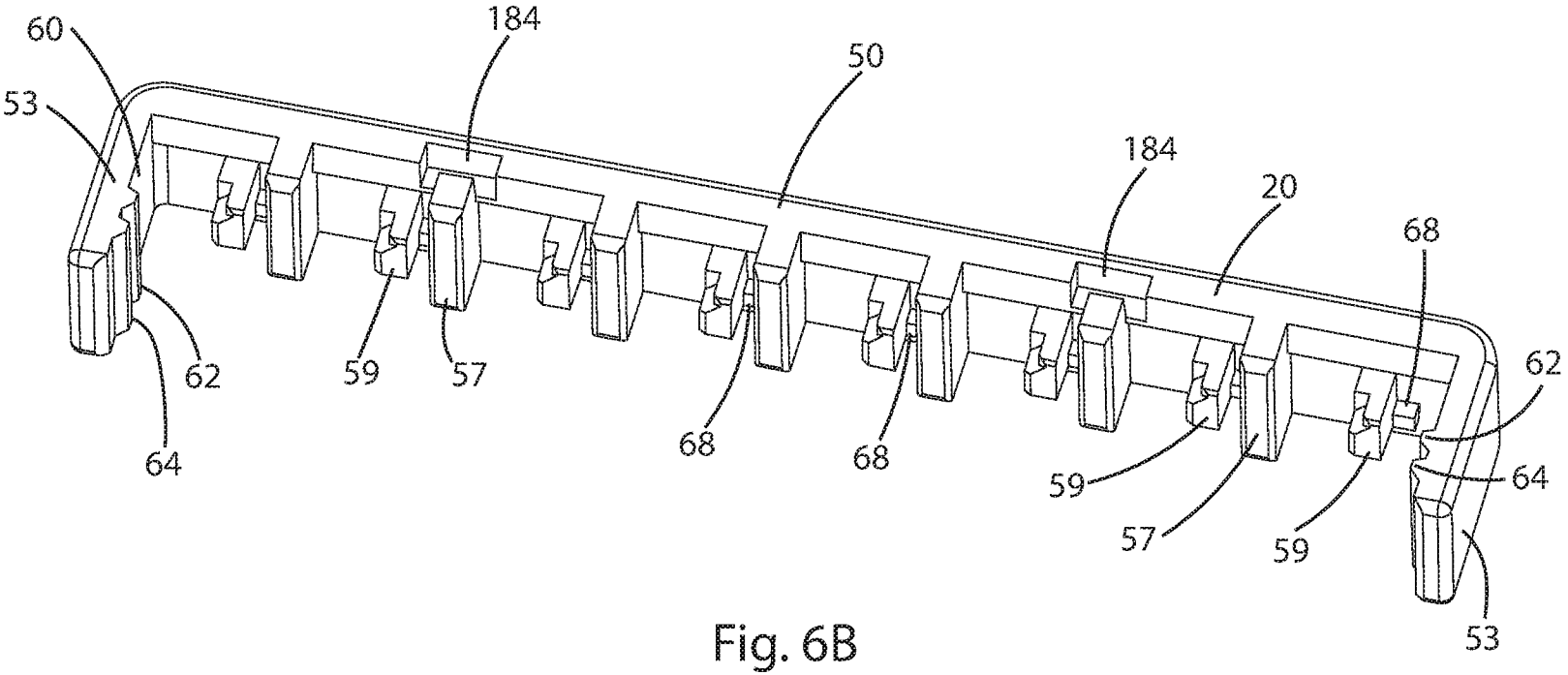
FIG. 6B is another bottom perspective view of the TPA device of this invention.

FIG. 6A is a bottom perspective view of the TPA device 20, while FIG. 6B is another perspective view of the TPA device 20. The TPA device 20 preferably includes an elongated member 50 with a pair of extending members 53 respectively extending at opposite ends of the elongated member 50. The pair of extending members 53 of the TPA device 20 extend in the same direction from the elongated member 50, and are substantially perpendicular to the elongated member 50. Extending substantially perpendicular and along the elongated member 50 of the TPA device 20, are first wall members 57, and second wall members 59. The first wall members 57 and second wall members 59 extend in the same direction from the elongated member 50, and are substantially perpendicular to the elongated member 50. Each of the extending members 53 also has an inner surface 60. The inner surface 60 of each extending member 53 having a lower protruding member 62 and an upper protruding member 64 extending from, and substantially perpendicular to, the inner surface 60. As more clearly shown in FIG. 6B, each of the first wall members 57 extending from the elongated member 50 of the TPA device 20 has a second wall member 59 adjacent thereto, although one of the second wall members 59 extends from the elongated member 50 without one of the first wall members 57 adjacent thereto between the said indicated second wall member 59 and a corresponding extending member 53. Between and connected to both the first wall member 57 and the second wall member 59 are short members 68, also similarly extending from the elongated member 50, although one of the short members 68 is connected to the one of the one of a second wall members 59 not having a first wall member 57 adjacent thereto, and is therefore not connected thereto a first wall member 57 by short member 68 and further, the short member 68 is located between the second wall member 59 and extending member 53.

Figure 7A:
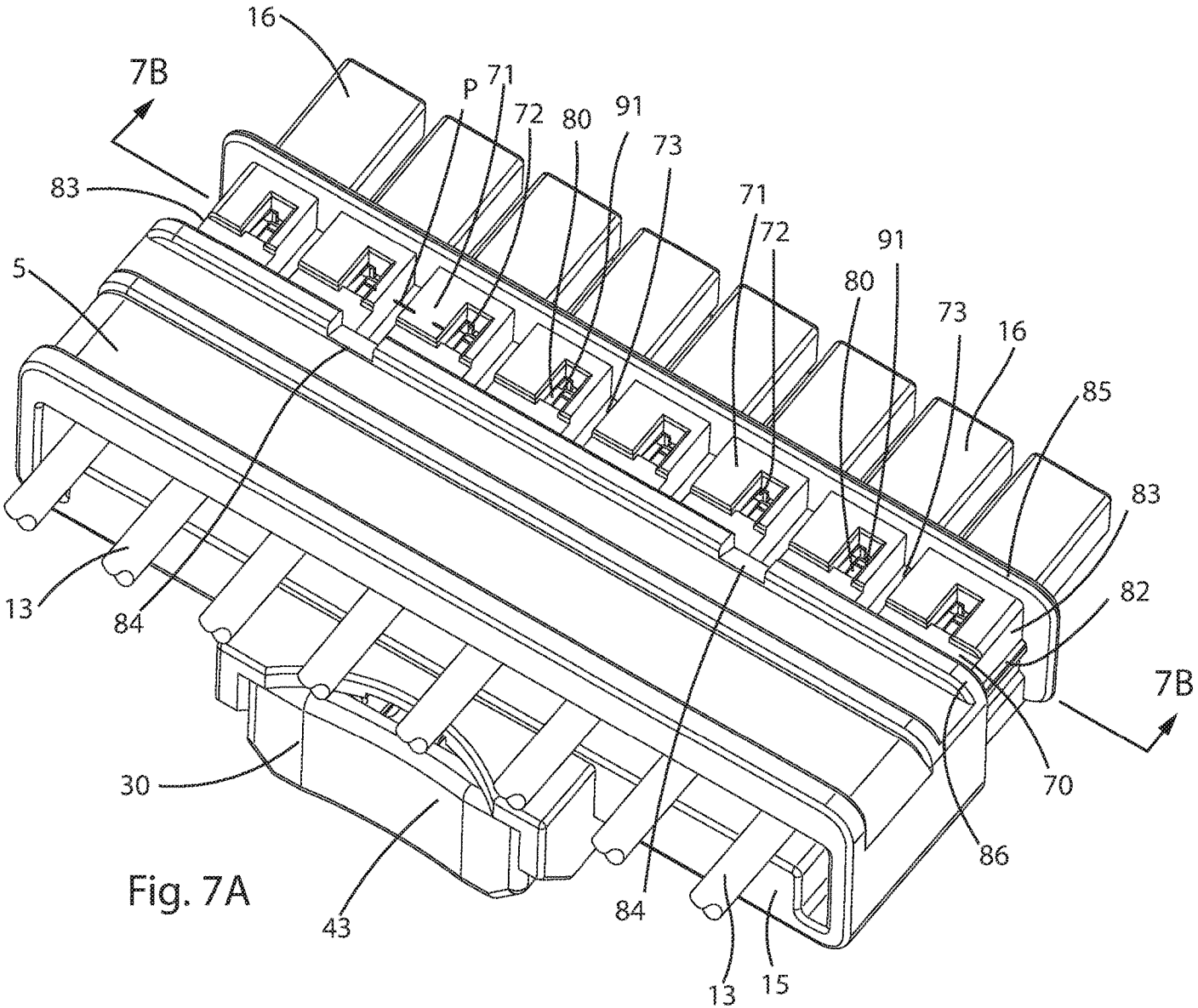

The bottom side of the female housing 5, as illustrated in FIG. 7A, generally includes an intermediate portion 70 for accommodating thereon the TPA device 20. The intermediate portion 70 includes a plurality of intermediate terminal housings 71. Each of the plurality of intermediate terminal housings 71 includes an aperture 72. Each of the plurality of apertures 72 respectively receives one of the second members 59 of the TPA device 20 when the TPA device 20 is in the pre-lock and full-lock positions. Additionally, between adjacent intermediate terminal housings 71 is an alley portion 73 for receiving therein one of the plurality of first members 57 of the TPA device 20 when the TPA device 20 is in the pre-lock and full-lock positions. As can also be seen in FIG. 7A, inside each of the plurality of apertures 72 is the terminal cavity 91 and here also aligned with the apertures 72 is a space 80 of each of the terminals 12 as the terminal 12 is locked into the female housing 5 and fully inserted. The terminal cavity 91 and space 80 of each of the terminals 12 accommodating therein a respective one of the second wall members 59 of the TPA device 20 for assuring a respective terminal 12 is locked inside the female housing 5, as will be more fully discussed below.

The plurality of front protruding receptacle members 16 and the back end 15 of the female housing 5 are also illustrated in FIG. 7A, the back end portion 15 of the female housing 5 respectively receiving the terminals 12 through openings 48 of the female housing 5 and the terminals 12 further residing into the terminal cavity 91 as they move into the female housing 5. As the terminals 12 enter further into the female housing 5, they are accommodated fully within the receptacle members 16 of the female housing 5. The receptacle members 16 include a terminal lock cavity 95 and a front portion of the terminal cavity 91 wherein the receptacle members 16 respectively accommodate the terminals 12 (See, FIGS. 10A-10C).

The CPA device 30, inserted into the female housing 5, is similarly shown n FIG. 7A. Further illustrated in FIG. 7A is a side portion 83 of the intermediate portion 70 of the female housing 5. Each of the side portions 83 of the female housing 5, includes a protruding member 82 which, as more fully discussed later, respectively engages with the lower protruding member 62 and the upper protruding member 64 extending from each of the inner surfaces 60 of the respective extending members 53 of the TPA device 20. Defining the location of the side portions 83 and the intermediate portion 70 of the female housing 5 are collar members 85, 86 for securing, protecting, and aligning the TPA device 20 when inserted thereon onto the intermediate portion 70 of the female housing 5. Also illustrated in FIG. 7A are a pair of notches 84 through the collar member 86. The notches 84 are of a rectangular shape and open near, into, and adjacent to the intermediate portion 70 of the female housing 5, the function of which will be further discussed below.

Figure 7B:
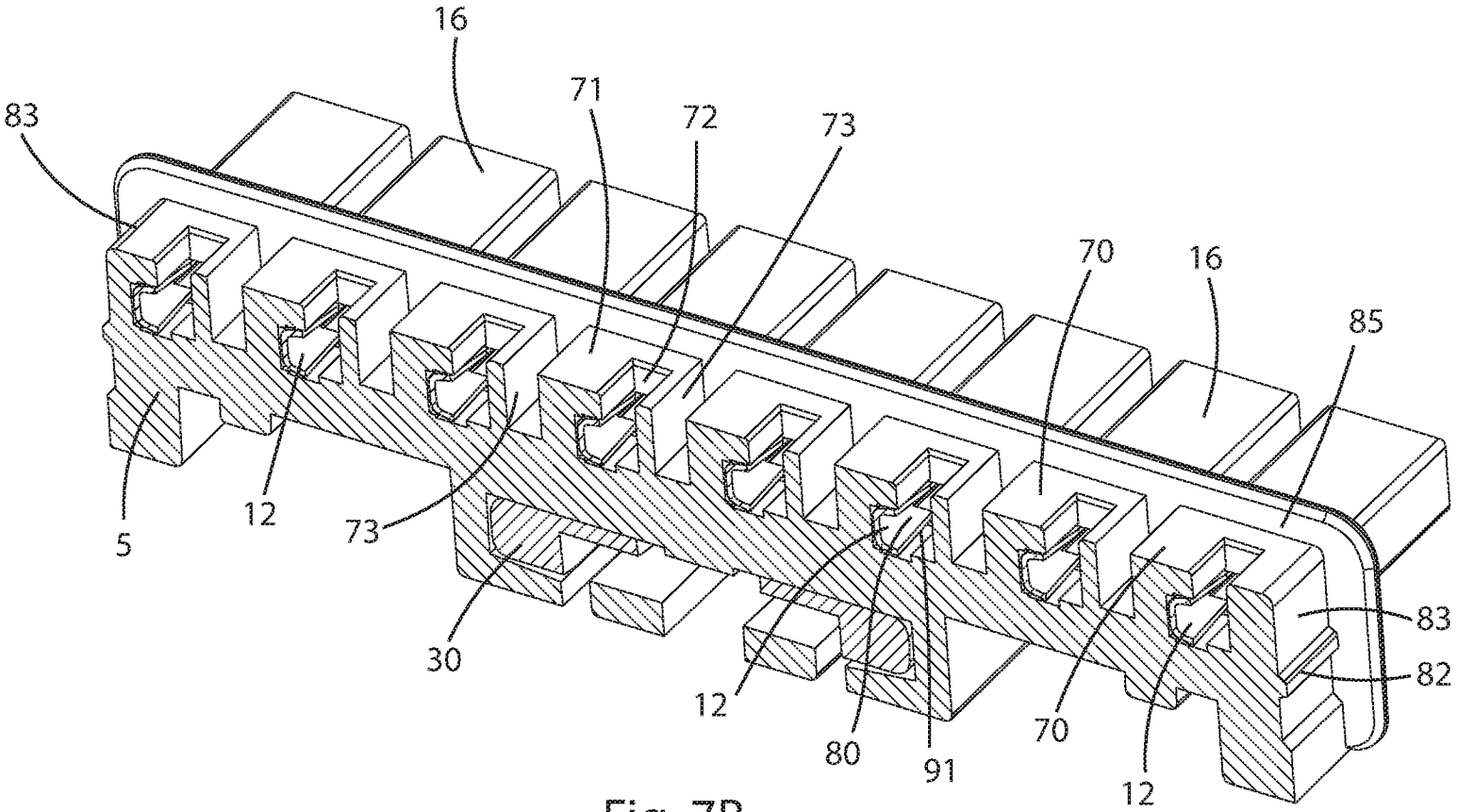
FIG. 7B is a cross-sectional view taken along line 7B-7B in FIG. 7A.

FIG. 7B is a cross-sectional view taken along line 7B-7B in FIG. 7A. More clearly shown in FIG. 7B is the protruding member 82 of the side portion 83 of the intermediate portion 70 of the female housing 5. Also clearly illustrated in FIG. 7B is the intermediate portion 70 of the female housing 5 having the plurality of intermediate terminal housings 71, each of the plurality of intermediate terminal housings 71 having an aperture 72. Each of the plurality of apertures 72 respectively receives one of the second wall members 59 of the TPA device 20, while between adjacent intermediate terminal housings 71 is the alley portion 73 for respectively receiving therein one of the plurality of first members 57 of the TPA device 20. The ends of the alley portions 73 are defined by the collar members 85, 86 being at an end of the alley portions 73 respectively. Further shown in FIG. 7B is the space 80 of the corresponding terminal 12 respectively aligned with one of the plurality of apertures 72 inside the terminal cavity 91 of the female housing and allowing for a respective one of the second wall members 59 of the TPA device 20 to be accommodated therein. When the second wall member 59 is accommodated in the space 80 of a corresponding terminal 12, the second wall member 59 of the TPA device 20 assures the terminal 12 remains locked and positioned within the female housing 5.

Figure 8A:
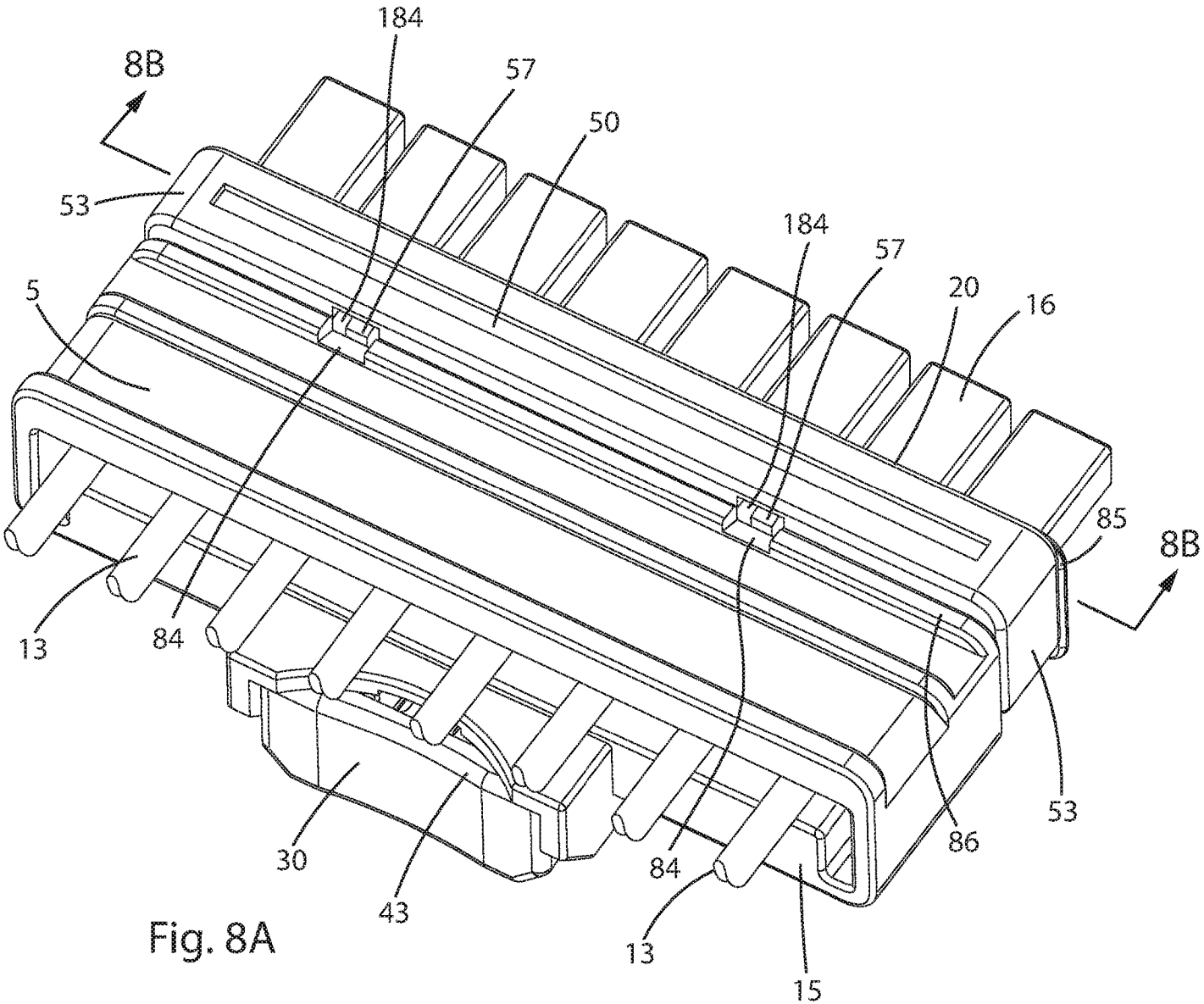

FIG. 8A shows the TPA device 20 secured and mounted, at a pre-lock position, onto the side portions 83 of the intermediate portion 70 of the female housing 5 and resides between the collar members 85, 86. As illustrated in FIG. 8A, one of the first members 57 extending from the elongated member 50 of the TPA device 20 (See, FIGS. 6A and 6B) can be seen through each of the notches 84 of the collar member 86. The notches 84 are substantially rectangular and provide access to the intermediate portion 70 of the female housing 5 and are aligned with a notch 184 of the TPA device 20 when the TPA device is in a pre-lock or full-lock position. If it is desired to remove the TPA device 20 from the female housing 5 from the pre-lock position, a tool (not shown) may be inserted into the notch 84 of the collar member 86 to push against a notch 184 of the TPA device 2. When the tool (not shown) enters into the notch 84, it is placed between the notch 84 of the collar member 86 and the notch 184 of the TPA device 20, and pushing away from the notch 84 the tool can move against the notch 184, thereby moving elongated member 50 of the TPA device 20 away from the intermediate portion 70 of the female housing 5. Further this operation continues to the point of fully removing and unlocking the TPA device 20 from the female housing 5 and the upper protruding member 64 traverses the protruding member 82.

Figure 8B:
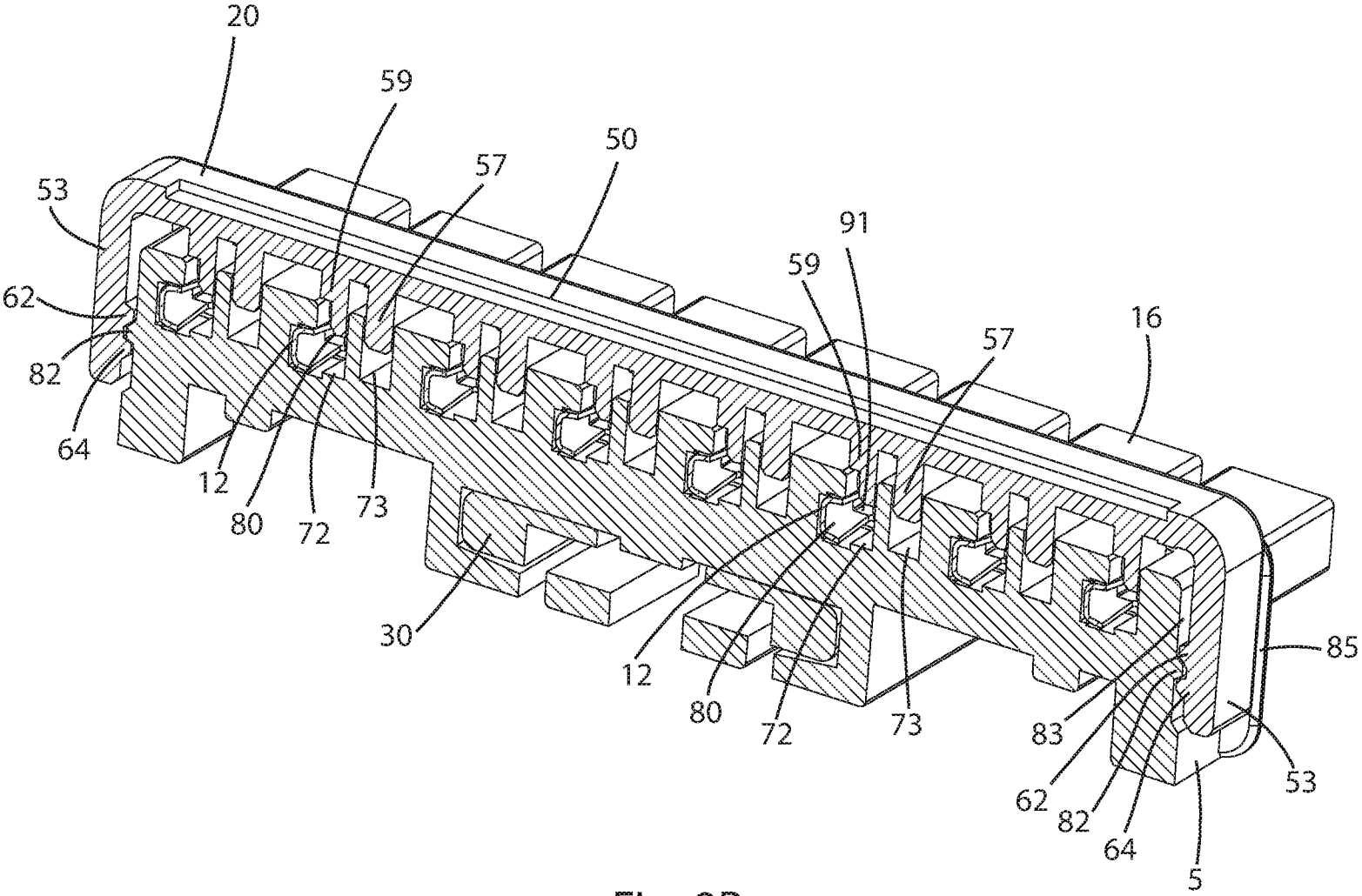
FIG. 8B is a cross-sectional view taken along line 8B-8B in FIG. 8A.

FIG. 8B is the cross-section, taken along line 8B-8B in FIG. 8A, which shows the TPA device 20 in the pre-lock position. Here, one of the first wall members 57 of the TPA device 20 enters and is respectively accommodated within one of the alley portions 73 of the inner housing 5, while one of the second wall members 59 of the TPA device 20 respectively enters into one of the plurality of apertures 72 of the female housing 5 of the female housing 5. Furthermore, the TPA device 20 in FIG. 8B is positioned in the pre-lock position whereby the inner surfaces 60 of the respective extending members 53 slides along a side portion 83 of the female housing 5 and the upper protruding member 64 in each of the extending members 53 of the TPA device 20 respectively engages and traverses the protruding member 82 of the side portion 83 of the female housing 5. Further, when the TPA device 20 is in in the pre-lock position, the protruding member 82 of the side portion 83 of the female housing is at a location positioned between the lower protruding member 62 and the upper protruding member 64 of the extending member 53 of the TPA device 20 which keeps the TPA device 20 locked onto the female housing 5.

Figure 9A:
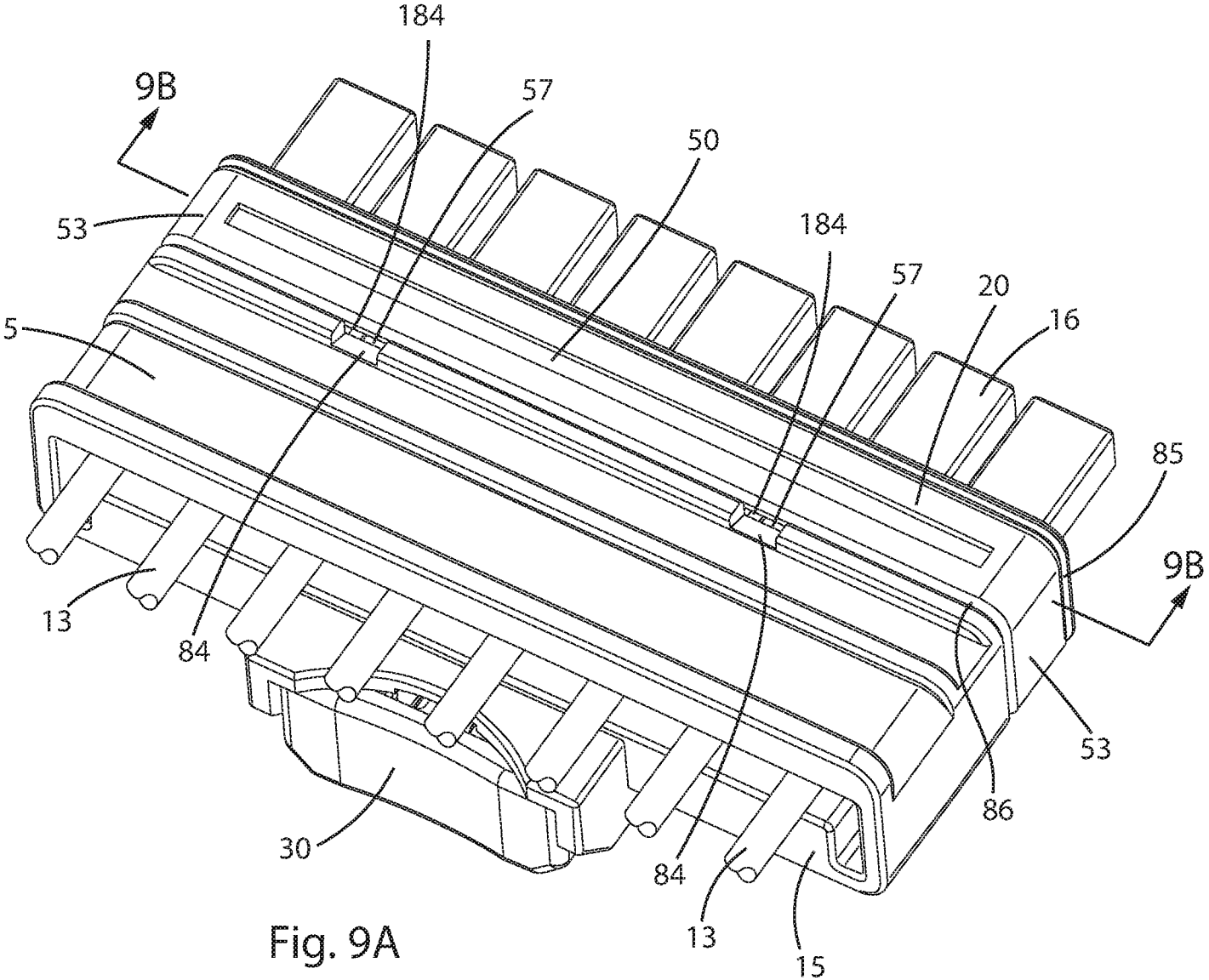

FIG. 9A shows the TPA device 20 secured and mounted, at a full-lock position, onto the intermediate portion 70 of the female housing 5 and between the collar members 85,86. In the process of moving the TPA device 20 from a pre-lock position to a full-lock position the inner surfaces 60 of respective extending members 53 slides along the side portions 83 of the female housing 5 and the lower protruding member 62 engages and traverses the protruding member 82 of the female housing 5. TPA device 20 resides fully between the collar members 85, 86 compared to the pre-lock position of TPA device 20, except for the exposed portions of the TPA device 20 in the notches 84 of the collar members 85, 86. As illustrated in FIG. 9A, the first wall member 57 extending from the elongated member 50 of the TPA device 20 (See, FIGS. 6A and 6B) can be seen through one of the notches 84 through the collar member 86 adjacent the intermediate portion 70 of the female housing 5. If it is desired to remove the TPA device 20 from the female housing 5, or move the TPA device 20 from a full-lock position to a pre-lock position, a tool (not shown) may be inserted into the notch 84 of the collar member 86 to push against a notch 184 of the TPA device 2. When the tool (not shown) enters into the notch 84, it is placed between the notch 84 of the collar member 86 and the notch 184 of the TPA device 20, whereby the tool can act upon and create leverage against the notch 84, pushing away from the notch 84 and against the notch 184, moving elongated member 50 of the TPA device 20 away from the intermediate portion 70 of the female housing 5. The lower protruding member 62 traverses the protruding member 82 during this process.

Figure 9B:
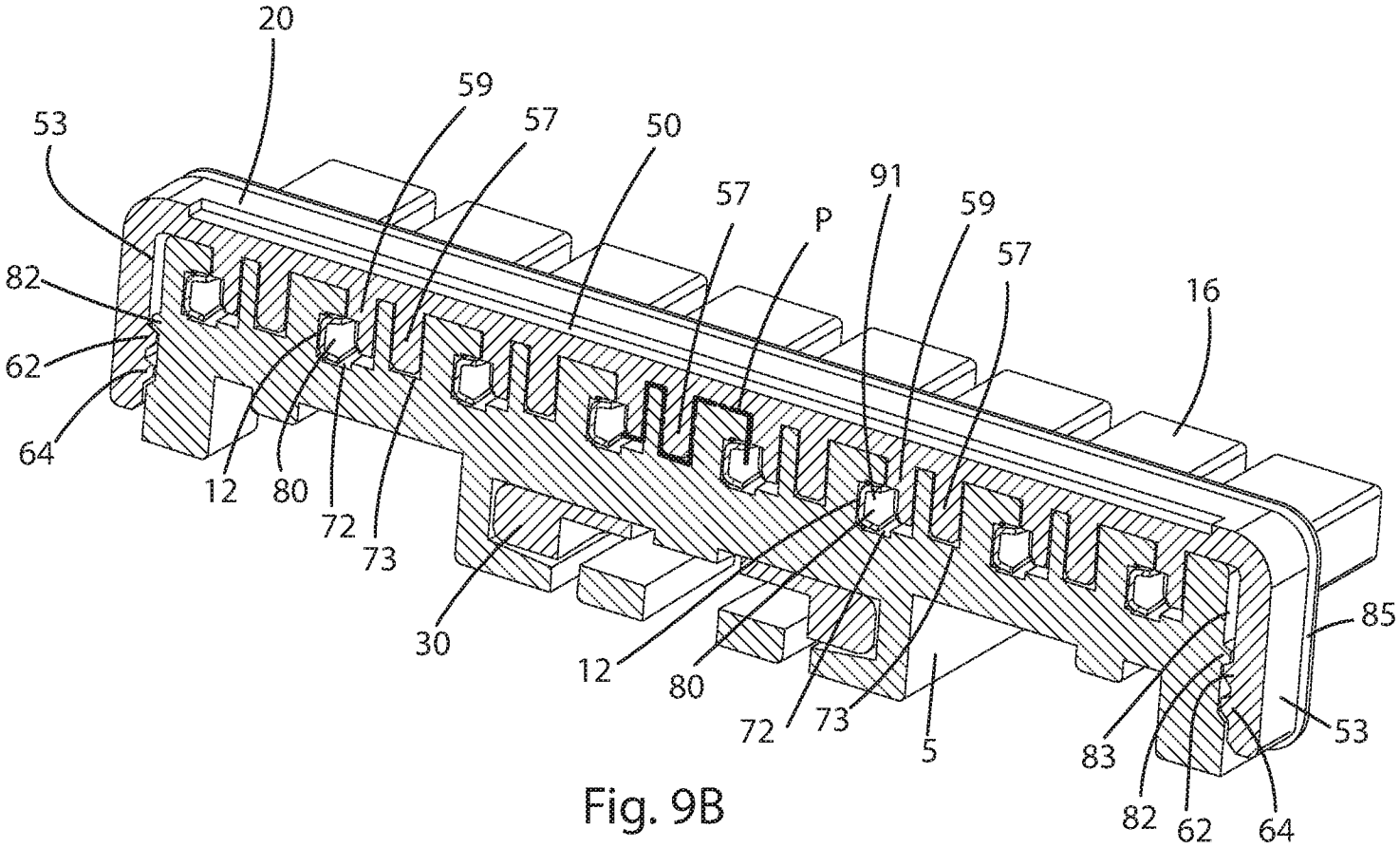
FIG. 9B is a cross-sectional view taken along line 9B-9B in FIG. 9A.
Figure 10A:
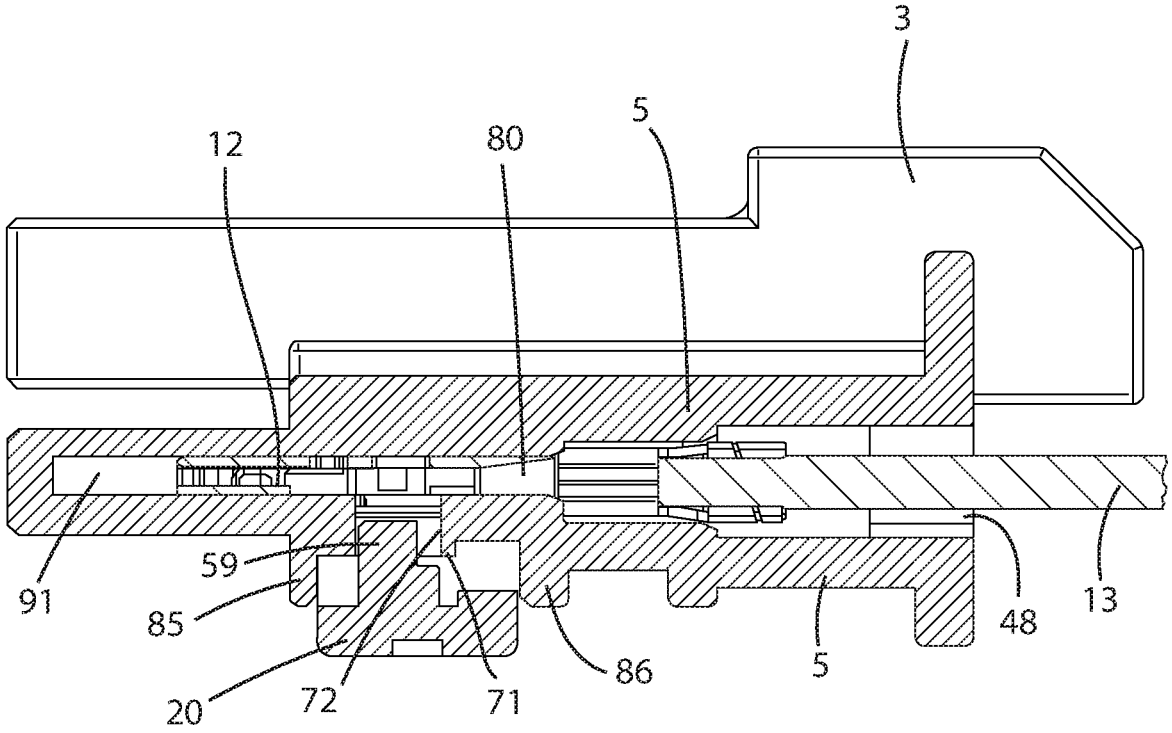

FIG. 9B is the cross-section, taken along line 9B-9B in FIG. 9A, which shows the TPA device 20 in the full-lock position. Here, the first members 57 of the TPA device 20 are respectively accommodated fully within one of the alley portions 73 of the inner housing 5 as compared to the pre-lock location of the first wall members 57 of the TPA device 20. Additionally, one of the second wall members 59 of the TPA device 20 respectively enters fully into and through one of the plurality of apertures 72 of the inner housing 5 and into the space 80 of the terminal 12 and terminal cavity 91 of the female housing 5. As will later be discussed, when the second wall member 59 of the TPA device 20 enters the space 80 of the terminal 12, the terminal 12 is blocked from being removed from the female housing 5. Furthermore, the TPA device 20 is positioned in the full-lock position when the lower protruding member 62 of the extending member 53 traverses the protruding member 82 of the side portion 83 of the female housing 5, and the protruding member 82 of the side portion 83 of the female housing 5 remains adjacent and between the lower protruding member 62 of the extending member 53 of the TPA device 20 and adjacent the elongated member 50 of the TPA device 20, FIG. 10A is a view of the female housing 5 having the terminal 12 partially inserted thereinto, and further showing the TPA device 20 in a pre-lock position. A portion of the terminal 12 is blocking a second wall member 59 of TPA device 20 from entering fully through one of the plurality of apertures 72 of the intermediate terminal housing 71, and into the space 80 of the terminal 12 and terminal cavity 91 of the female housing 5. In FIG. 10A, the space 80 of the terminal 12 and the aperture 72 are not aligned.

Figure 10B:
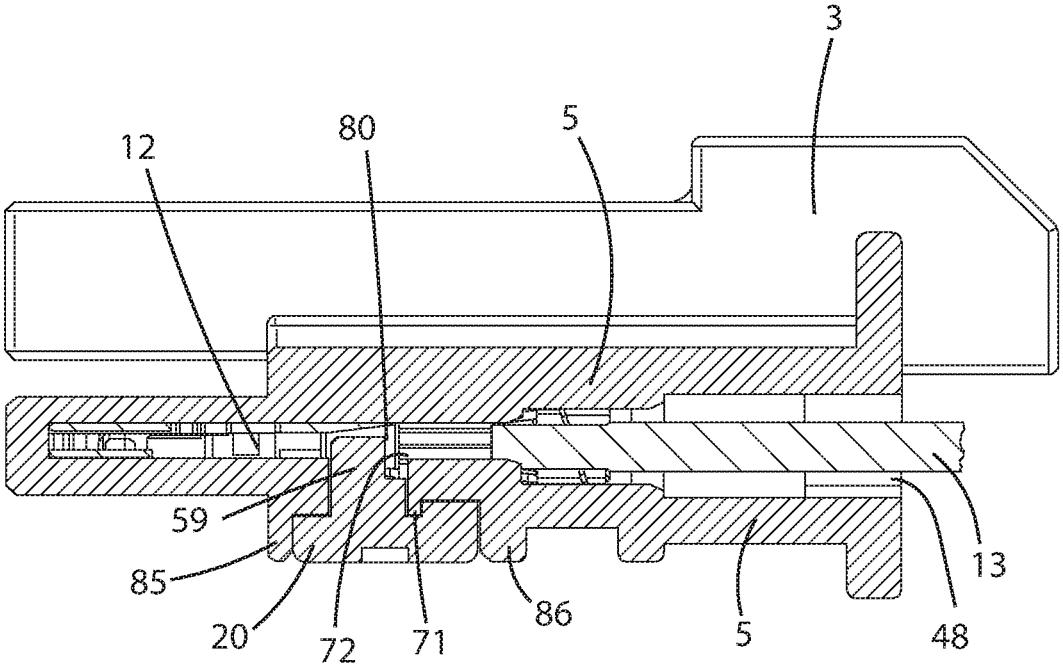
FIG. 10B is a cross-sectional view, taken along line 10B-10B of FIG. 3, of the terminal fully inserted and locked into the female housing and showing the TPA device in a full-lock position.
Figure 10C:
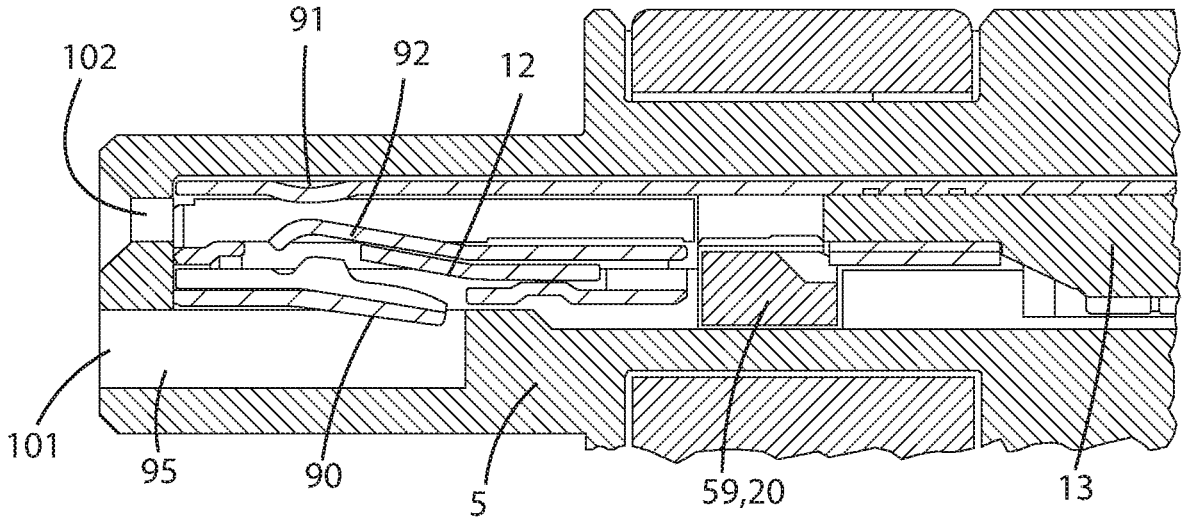
FIG. 10C is a view, of the terminal having a wire or cable, the terminal being in the full-lock position, showing a lever member thereof extending into a terminal lock cavity inside the female housing to prevent the terminal from being pulled out from the female housing.

As shown in FIG. 10B, the TPA device 20 is in a full-lock position, wherein the space 80 of the terminal 12 is substantially aligned within the terminal cavity 91 to the aperture 72 of the intermediate terminal housing 71 of the female housing 5; and thus, the second wall member 59 of the TPA device 20 enters into the space 80 of the terminal 12 as the TPA device 20 is in the full-lock position. With the TPA device 20 in a full lock position, the respective portions of the TPA device 20 are fully inserted into and/or onto the female housing 5. At the same time, the second member 59 of the TPA device 20, now having entered the space 80, interacts with and/or blocks the terminal 12 (and therefore, the electrical wire or cable 13) from being pulled out or removed from the female housing 5. Additionally, as mentioned above with respect to FIG. 9B, the TPA device 20 is at a full-lock position whereby both the upper protruding member 64 and the lower protruding member 62 in each of the extending members 53 of the TPA device 20 have respectively traversed the protruding member 82 of a respective side portion 83 of the female housing 5.

In addition to the above-described blockage of the terminal 12 by the second wall member 59 of the TPA device 20, which prevents terminal 12 from being removably pulled out from the female housing 5, the terminal 12 includes, for example, the preferably resilient lever member 90, and a two-bodied spring member 92 for accommodating the pins 8 of the male housing 3. The lever member 90, when the terminal 13 is fully inserted into the female housing 5, occupies a terminal lock cavity 95 within the female housing 5. The terminal lock cavity 95 provides a surface which interacts with the lever member 90 and prevents it from being pulled out, further providing a primary lock for the terminal 12 within the female housing 5. When the lever member 90 of the terminal 12 occupies the terminal lock cavity 95, this condition provides the primary lock for the terminal 12, and when the TPA device 20 is fully inserted and at full-lock position (as described above), the TPA device 20 provides the secondary lock for the terminal 12. Further, the front end portion 11 of the female housing 5 has an aperture 101 at the end of each receptacle 16 which, wherein, the aperture 101 is aligned with the terminal lock cavity 95 such that a tool (not shown) may be inserted to press the lever member 90 of the terminal 12 and allow the lever member 90 to no longer interact with the terminal lock cavity 95 and move the lever member 90 away from, and completely out of, the terminal lock cavity 95; therefore, the terminal 12 is unlocked and this condition allows the terminal 12 to be removed or movable out of the female housing 5 in a direction toward the direction it was inserted (the direction toward the back end portion 15 of the female housing 5). (See, FIG. 10C)

Herein described is the method for engaging the TPA device 20, at the pre-lock position and the full-lock position, in the low profile high voltage connector 1 of this invention. The plurality of terminals 12 are first inserted into the final cavity 91 of the female housing 5. The terminals 12 are further moved into the terminal cavity 91 until the lever member 90 of each of the terminals 12 occupies the terminal lock cavity 95 and locks the terminal 12 within the female housing 5, preventing the terminal 12 from being removably pulled out, and providing a primary lock for the terminal 12 within the female housing 5. (See, FIG. 10C.) However, prior to the terminal 12 being fully inserted into the female housing 5 and fully locked within the female housing 5, the terminal 12 is positioned as described above in FIG. 10A. As previously discussed, in FIG. 10A, the TPA device 20 is in a pre-lock position, and cannot be inserted through the aperture 72 of the intermediate terminal housing 71 of the female housing 5 because a portion of the terminal 12 blocks the second wall member 59 of the TPA device 20 from entering into the terminal cavity 91. Further, the space 80 of the terminal 12 is not aligned with the aperture 72 until the terminal 12 is fully inserted into the terminal cavity 91 and receptacle member 16. First, the upper protruding member 64 of each of the extending members 53 of the TPA device 20 transverses the protruding member 82 of the side portion 83 of the female housing. Then the TPA device 20 remains at a pre-lock position, whereby the upper protruding member 64 in each of the extending members 53 of the TPA device 20 traverses and is on one side of the protruding member 82 of the side portion 83 of the female housing 5, while the lower protruding member 62 is on the opposite side of the protruding member 82.

When the terminal 12 is further inserted into the female housing 5, as described earlier with respect to FIGS. 10B and 10C, the terminal 12 is fully inserted into the terminal cavity 91 and receptacle member 16 and lever member 90 residing in the terminal lock cavity 95 providing a primary lock. At this time, the space 80 of the terminal 12 becomes substantially aligned with the aperture 72 of the intermediate terminal housing 71 of the female housing 5, as shown in FIG. 10B. With the space 80 of the terminal 12 being substantially aligned with the aperture 72 of the intermediate terminal housing 71 of the female housing 5, the second member 59 of the TPA device 20 enters into the space 80 of the terminal 12 as well as into the terminal cavity 91 and through the aperture 72 of the female housing 5 and allows the TPA device 20 to be fully inserted. During this process, the TPA device 20 moves to a full-lock position, whereby the lower protruding member 62 in each of the extending members 53 of the TPA device 20 respectively, traverses the protruding member 82 of each respective side portion 83 of the female housing 5. (See, FIG. 9B.) At the full-lock position of the TPA device 20, the second member 59 of the TPA device 20, having entered the space 80 of the terminal 12, blocks the terminal 12 as a secondary lock; and thus, the terminal 12 is further assured that it will be prevented from being pulled out or removed from the female housing 5.

Figure 11:
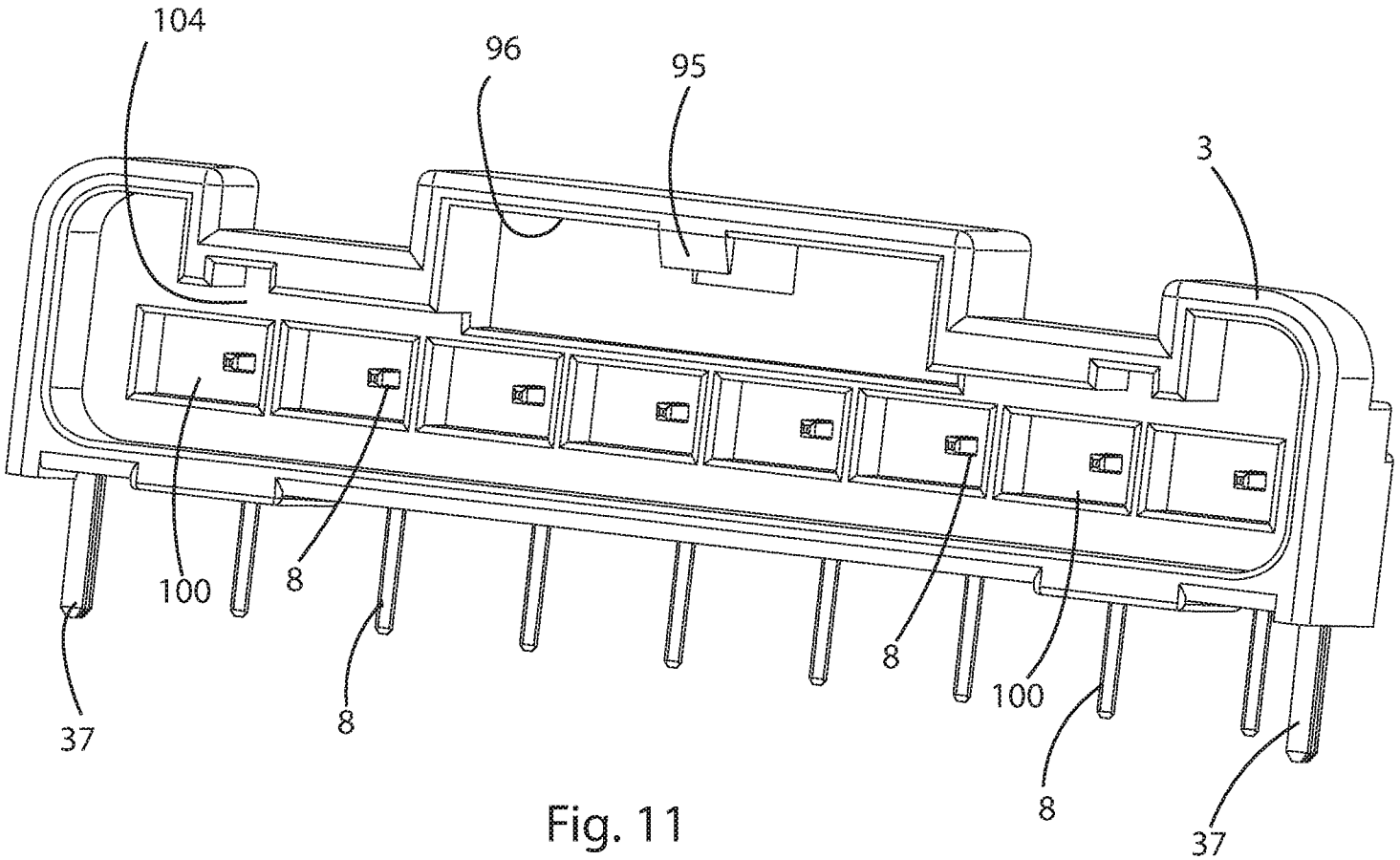
FIG. 11 is a perspective view of the male housing, showing the inside of the cavity of the male housing, and a lock member extending from the upper portion of the housing and into the cavity thereof, and further showing a plurality of inside spaces for respectively receiving therein receptacle members of the female housing.

FIG. 11 is a perspective view showing an inside of the male housing 3 and further showing a lock member 95 extending from an upper portion 96 of the male housing 3. Further shown in FIG. 11 are the plurality of separate inside spaces 100 for respectively accommodating therein pins 8, and similarly shaped to, the plurality of protruding receptacle members 16 extending as the front end portion 11 of the female housing 5. The plurality of receptacle members 16 separately extend fully into the plurality of inside spaces 100 when the female housing 5 is fully inserted into the male housing 3. The plurality of protruding receptacle members 16 of the female housing 5 respectively accommodate therein the terminals 12 and the pins 8 of the male housing 3 when they enter into aperture 102 of the female housing 5 during mating of the male housing 3 and female housing 5. (See FIG. 14A, 14B)

Figure 12:
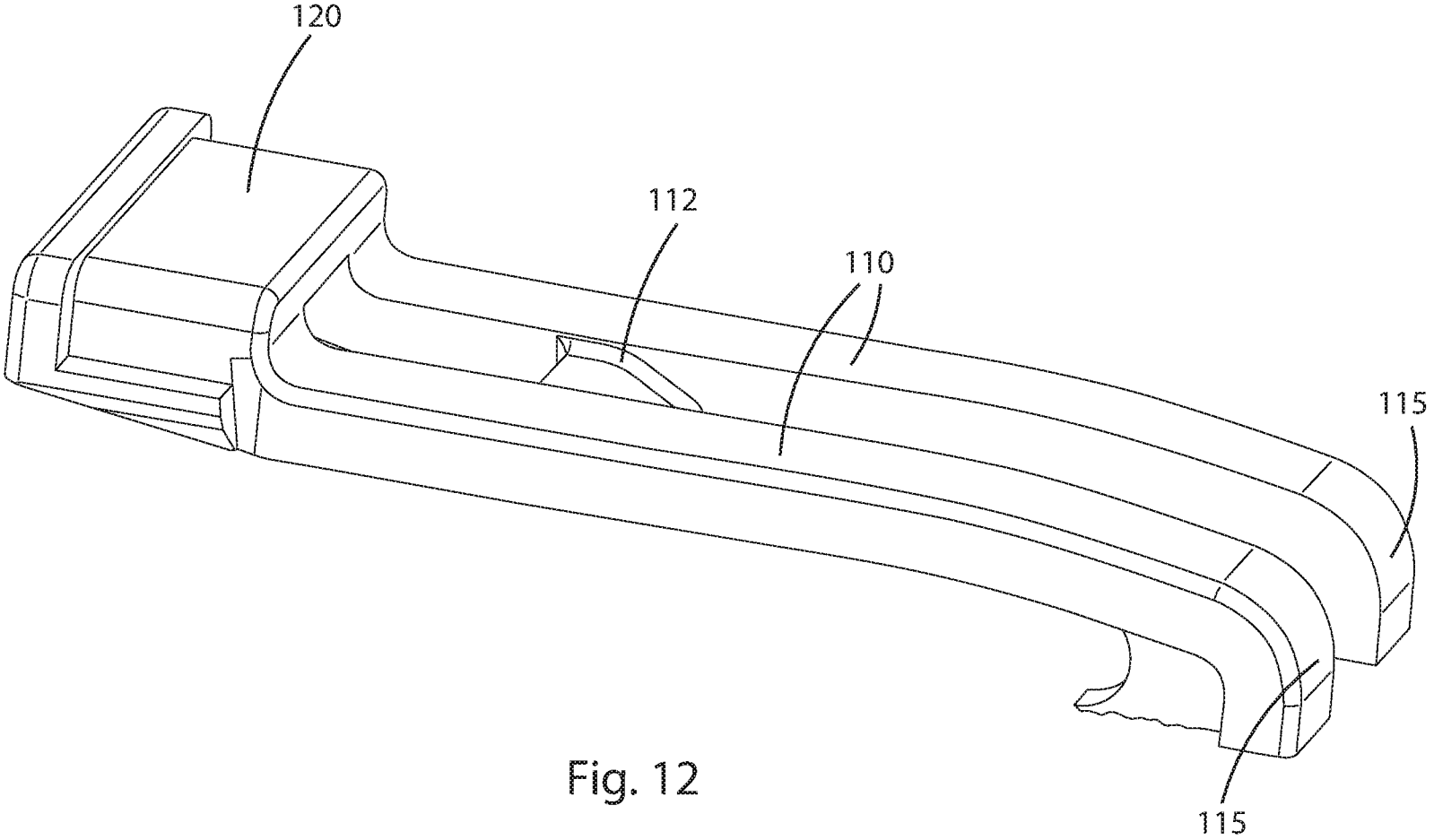
FIG. 12 is a side perspective view of a set of centrally located flexible members of the female housing and a central lock member located between the pair of the centrally flexible members.

FIG. 12 is a side perspective view of the set of centrally located flexible members 110 of the top portion of the female housing 5. Between the centrally located flexible members 110 is a ramp-like central lock member 112. Front portions 115 of the flexible members 110 are connected above and behind the centrally located protruding receptacle members 16 extending at the front end portion 11 of the female housing 5. (See FIG. 1A, 1B, 14A) More specifically, the pair of centrally located flexible members 110 act as a lever, and at a front end are fixedly attached to a portion of the female housing 5 toward a front end portion 11 thereof, and the back end of the centrally located flexible members 110 are freely movable with, and joined to a joint member 120. (See FIGS. 1A, 1B, and 2-5)

Figure 13:
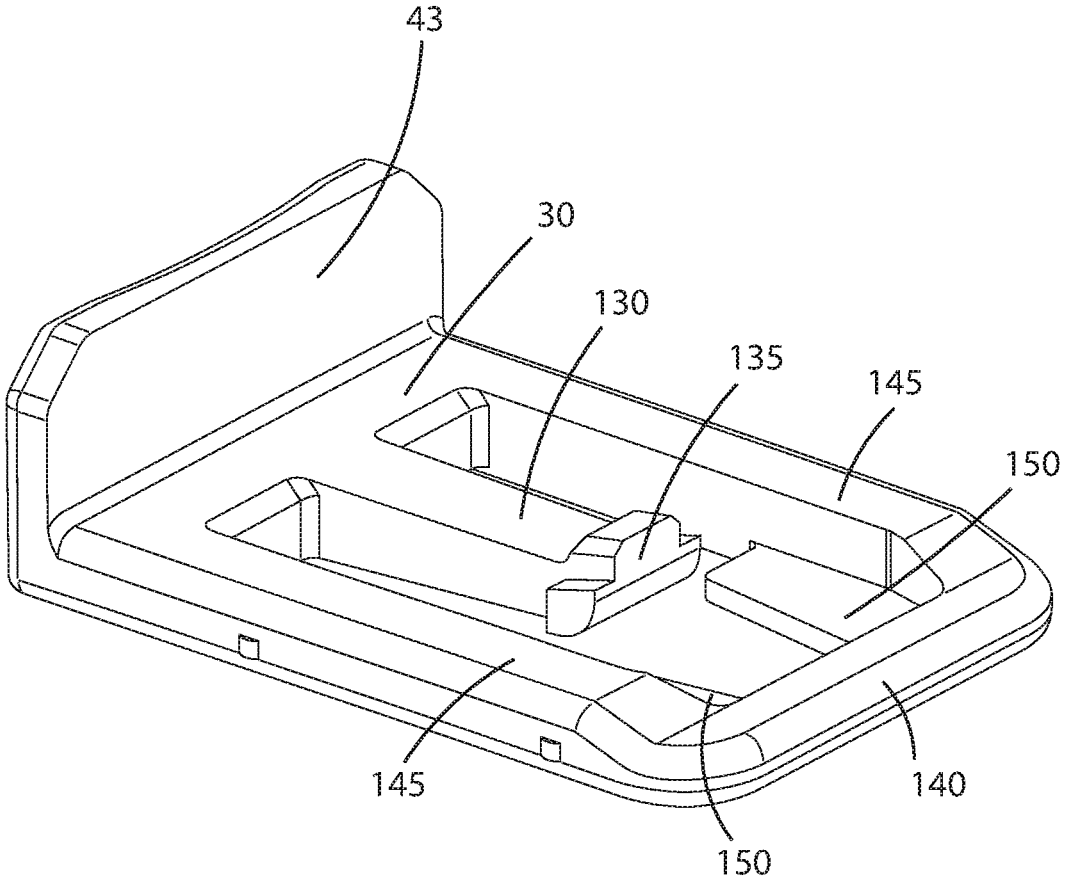
FIG. 13 is a front perspective view of the CPA device showing the centrally located flexible member and a lock member at the end thereof.

FIG. 13 is a perspective view of the connector position assurance (CPA) device 30 of the low profile high voltage connector 1 of this invention. The CPA device 30 includes a centrally located flexible member 130 and a lock member 135 at the end thereof. The CPA device 30 includes the head member 43 and a front member 140 connected to side members 145. Respectively extending from within the front member 140 and the side members 145 of the CPA device 30, are inside members 150 which add support thereto the front member 140 and side members 145.

Figure 14A:
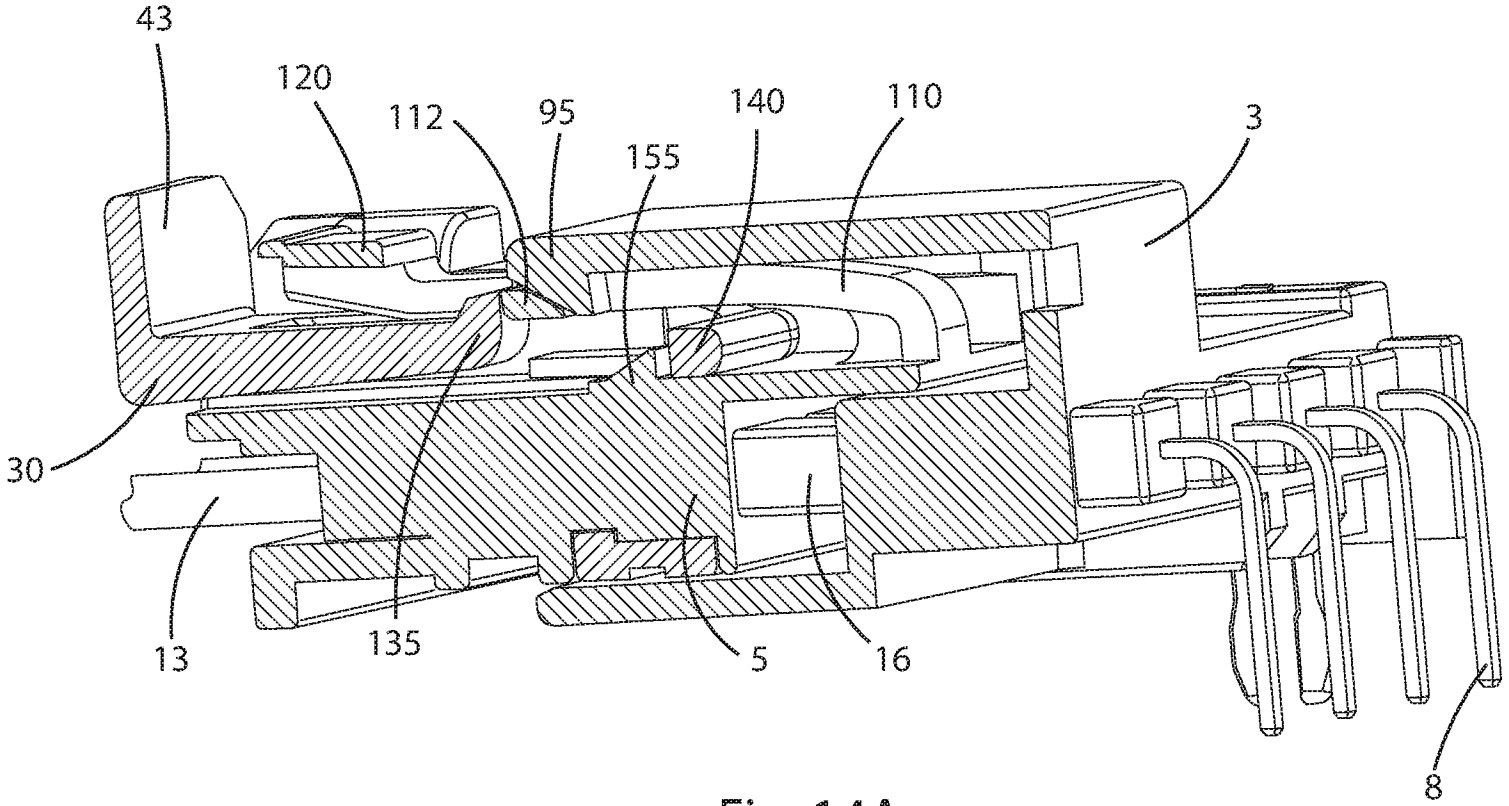
Figure 14B:
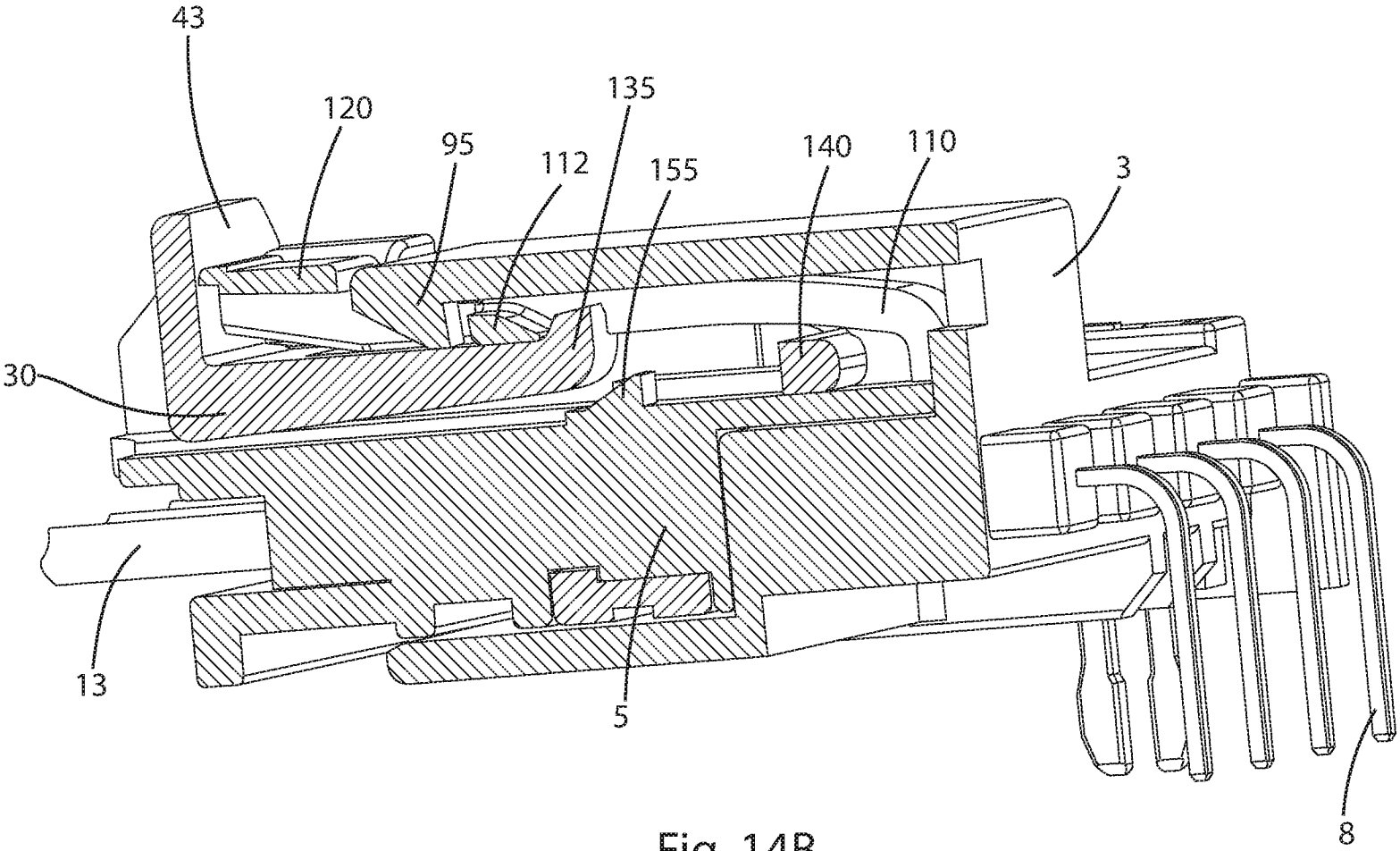
FIG. 14B is a cross-sectional view of the low profile high voltage connector of this invention, taken along line 14B-14B of FIG. 3, showing the CPA device in a full-lock position.

FIG. 14A is a cross-sectional view of the low profile high voltage connector 1 of this invention, taken along line 14A-14A of FIG. 2, showing the CPA device 30 in a pre-lock position. In FIG. 14A, the female housing 5 is shown as having been inserted into the male housing 3, the TPA device 20 in a full-lock position, and the CPA device 30 as having been inserted into the female housing 5 at a pre-lock position. To enter the pre-lock position, the front member 140 of the CPA device 30 travels along a ramp member 155 inside the female housing 5 and, for the time being in FIG. 14A, stays past the ramp member 155 and positioned in the pre-lock position. While the lock member 95 of the male housing 3 is aligned between the set of centrally located flexible members 110 above the female housing 5 while for the time being, the lock member 95 of the male housing 3 stays frontward and adjacent to the central lock member 112 of the female housing 5 located between the centrally located flexible members 110. Also, the lock member 135 of the CPA device 30 stays adjacent or abuts rearward of the central lock member 112 of the female housing 5, so that the central lock member 112 remains between the lock member 135 of the CPA device 30 and the lock member 95 of the male housing 3. The CPA device 30 stays, at this pre-lock position, until the male housing 3 and female housing 5 are further pushed together, thereafter, as described further below in FIG. 14B, FIG. 14B is a cross-sectional view of the low profile high voltage connector 1 of this invention, taken along line 14B-14B of FIG. 3, showing the CPA device 30 in a full-lock position. Described below is the method for moving the CPA device 30 into a full-lock position, and for locking the female housing 5 and the male housing 3 together. More particularly, as illustrated in FIG. 14B, the front member 140 of the CPA device 30 travels further into the female housing 5 (and subsequently, into the male housing 3) away from the lock member 155 and towards the front end portion 11 of the female housing 5. When the female housing 5 is inserted into the male housing 3, the centrally located lock member 95 of the male housing 3 travels or traverses over the inclined central lock member 112 (between the set of centrally located flexible members 110 above the female housing 5, as shown in FIG. 12) which depresses, or flexes downward with the flexible members 110 until such time as the lock member 95 resides onto the lock member 135 of the CPA device 30. At this point, the male housing and female housing are fully mated, locked together and the lock member 95 of the male housing 3 remains blocked by the ramp member 155 of the female housing 5; and thus the female housing 5 is unable to be dislodged or removed from the male housing 3. As seen in FIG. 14B, the male housing 3 and female housing 5 are unable to be separated unless the joint member 120 of the free end of the centrally located flexible members 110 of the female housing 5 is depressed and moves the central lock member 112 of the female housing to a position where the lock member 95 of the male housing 3 is free to traverse back over the central lock member 112 of the female housing unobstructed and the male housing 3 is removable from the female housing 5 in a direction opposite the direction of mating (the back end 10 of the male housing 3 moving away from the front end portion 11 of the female housing 5). When the lock member 95 of the male housing 3 traverses the lock member 135 of the CPA device 30, it depresses the flexible arm 130 of the CPA device 30 from which the lock member 135 protrudes upwardly from, and the CPA device 30 is in condition to be further pushed into the full-lock position, whereby the flexible arm 130 flexes downward and traverses under the central lock member 112 of the female housing 5 and the CPA device 30 resides further into the cavity 104 of the male housing 3. When the CPA device 30 is in a full-lock position, the centrally located lock member 95 of the male housing rests behind the inclined central lock member 112 of the female housing 5 and the lock member 135 of the CPA device 30 rests on an opposite side of the central lock member 112 from where it resided in a pre-lock position and remains blocked by the central lock member 112 of the female housing 5. When the CPA device 30 is in the full-lock position, the male housing 3 and female housings 5 are assured or prevented from being unlocked from each other whereby a portion of the CPA device 30 moves under the centrally located flexible members 110 and prevents them from moving downward or being depressed at the joint member 120. This condition thereby assuring the male housing 3 and female housing 5 are not unlocked or separable by depressing the joint member 120, as described earlier.

Additionally, once the male housing 3 and female housing 5 are mating, the pins 8 of the male housing 3 enter an aperture 102 on the female housing 5 where the terminal cavity 91 meets the front end portion 11 of the female housing. Therefore, as the receptacle members 16 enter the spaces 100 in the male housing 5 where the pins 8 of the male housing 5 reside, the pins 8 are aligned with the apertures 102 of the female housing where the terminal cavity 91 meets the front end portion 11 of the female housing 5, and thereby enter the aperture 91 and the terminal cavity 91 and also enter into the corresponding terminal 12 residing in the receptacle members 16 of the female housing 5.

As seen in FIG. 9B, the TPA device 20 of the present invention also has wall members which assist in increasing the creepage and clearance of the high voltage connector between adjacent terminals 12 when they are inserted into the female housing 5 and in operation with the TPA device 20 at a full-lock position. As seen in more detail in FIG. 9B, the first wall member 57 acts as a type of "wall" or "barricade" within the alley portions 73 of the female inner housing 5, and is located substantially between the terminals 12, when the male IPA device 20 is in operation and within the female housing 5. When in operation, the first wall member 57 further and substantially adds a surface in a lengthwise direction of the female housing 5, and within the alley portions 73 of female housing 5 in which the electrical path P, is substantially directed across. Consequently, the first wall member 57, therefore increases creepage, and consequently the clearance of the electrical path P by directing the electrical path P around its surface. Comparatively, if the female housing 5 is in operation, absent the TPA device 20 of the present invention, the electrical path P has a smaller clearance from one terminal 12 to another adjacent terminal 12, than when the TPA device 20 resides in a pre-lock or full-lock orientation (See, path e.g. FIG. 7A). Additionally, and advantageously, the elongated member 50 of the TPA device 20 prevents the electrical path P, between the terminals 12, from traveling or traversing over the top of the TPA device 20. The inner and outer surface of the lower member, have a surface distance between the terminals 12, greater than the creepage or clearance surface provided by the surface along the elongated member 50 and with alley portions 73. Thereby, the clearance and creepage of the electrical path P extending and along the TPA device 20, is directed around the first wall member 57 (See, path P, e.g. FIG. 9B).

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

We claim:

1. A low profile high voltage connector, comprising:

a male housing having a plurality of pins inserted therein;

a female housing having a plurality of electrical wires or cables inserted therein and a set of centrally located flexible members thereabove;

a terminal position assurance (TPA) device insertable into said female housing for locking said plurality of wires or cables inside said female housing, said TPA device insertable into said female housing at one of a pre-lock position and a full-lock position; and a connector position assurance (CPA) device insertable into said female housing for locking said male housing and said female housing together, said CPA device insertable into said female housing at one of a pre-lock position and a full-lock position, wherein said female housing further comprises a ramp member between said set of centrally located flexible members, wherein said female housing further comprises a joint member for joining back portions of said set of centrally located flexible members, and wherein front portions of said set of centrally located flexible members are connected above centrally located protruding members extending from a front portion of said female housing.

2. The low profile high voltage connector according to claim 1, further comprising at least a metallic retention tab connected to said male housing, said male housing being mounted onto a printed circuit board (PCB) with said metallic retention tab.

3. The low profile high voltage connector according to claim 1, wherein said male housing comprises a lock member extending from an upper portion thereof, a plurality of inside spaces for respectively accommodating therein a plurality of protruding members extending from said female housing when said female housing is inserted into said male housing, said plurality of protruding members of said female housing respectively accommodating therein wire core portions of said electrical wires or cables.

4. The low profile high voltage connector according to claim 3, wherein said female housing further comprises, adjacent to said lock member, another space for accommodating therein a tool that is inserted through said space to push said TPA device away from said female housing to dislodge or remove said TPA device from said female housing when desired, said TPA device being at one of said pre-lock position and said full-lock position.

5. The low profile high voltage connector according to claim 1, wherein said TPA device comprises:

an elongated member with extending members respectively extending at opposite ends of said elongated member, first and second members extending along said elongated member, each of said extending members has an inner surface, and a lower protruding member and an upper protruding member extending from said inner surface of each of said extending members.

6. A method for assembling a low profile high voltage connector having a male housing with a plurality of pins inserted therein, a female housing with a plurality of electrical wires or cables inserted therein, a terminal position assurance (TPA) device insertable into said female housing for locking said plurality of wires or cables inside said female housing, and a connector position assurance (CPA) device insertable into said female housing for locking said male housing and said female housing together, each of said TPA device and said CPA device being insertable into said female housing at one of a pre-lock position and a full-lock position, said method comprising the steps of:

inserting wire core portions of said plurality of electrical wires or cables into said female housing;

inserting said TPA device into said female housing at a pre-lock position, said wire core portions of said plurality of electrical wires or cables blocking said TPA device from further entering said female housing;

further inserting said wire core portions of said plurality of electrical wires or cables into said female housing, a tang member of each of said wire core portions being accommodated inside a cavity inside said female housing;

substantially aligning a space within said wire core portion with an aperture passing through an intermediate terminal housing of said female housing;

allowing a member extending from said TPA device to pass through said aperture of said intermediate terminal housing of said female housing and said space within said wire core portion of said electrical wire or cable;

further inserting said TPA device into said female housing at a full-lock position within said female housing, wherein said step of further inserting said TPA device into said female housing at said full-lock position comprises a step of blocking each of said wire core portions of said plurality of electrical wires or cables from being removed or dislodged away from said female housing.

7. The method for assembling the low profile high voltage connector according to claim 6, wherein said step of inserting said TPA device into said female housing at a pre-lock position further comprises the step of an upper protruding member extending from an inner surface of each of extending members at each end of said TPA device traverses a protruding member respectively extending from one of opposing sides of said female housing.

8. The method for assembling the low profile high voltage connector according to claim 7, wherein said step of inserting said TPA device into said female housing at a full-lock position further comprises the step of a lower protruding member and said upper protruding member extending from said inner surface of each of said extending members at each end of said TPA device traverses said protruding member respectively extending from one of said opposing sides of said female housing.

9. The method for assembling the low profile high voltage connector according to claim 6, further comprising a step of inserting said CPA device into said female housing at said pre-lock position, wherein said step of inserting said CPA device into said female housing at said pre-lock position comprises a step of pushing said CPA device such that a front member of said CPA device travels along a ramp member inside said female housing and stays past the ramp member, while a lock member of said male housing traverses between a set of centrally located flexible members above said female housing and stays adjacent to said ramp member located between said centrally located flexible members of said female housing, said ramp member remaining between said lock member of said CPA device and said lock member of said male housing.

10. The method for assembling the low profile high voltage connector according to claim 9, further comprising a step of further inserting said CPA device into said female housing at said full-lock position, wherein said step of further inserting said CPA device into said female housing at said full-lock position comprises the steps of:

further pushing the CPA device such that said front member of said CPA device travels further into said female housing and away from said ramp member inside said female housing;

having said lock member of said male housing travel past said ramp member of the said female housing and said lock member of said CPA device, while said ramp member between said centrally located flexible members of said female housing flexes downward;

having said lock member of said CPA device 30 traverse past said lock member of said male housing and said ramp member of said female housing 5;

blocking said lock member of said male housing by said ramp member of said female housing; and preventing said female housing and said male housing from being dislodged or removed from each other.

11. The method for assembling the low profile high voltage connector according to claim 10, wherein said preventing said female housing and said male housing from being dislodged or removed from each other comprises steps of keeping said lock member of said CPA device blocked by said ramp member of said female housing, keeping said set for centrally located flexible members of said female housing from being flexed downward; keeping said CPA device at said full-lock position inside said female housing; and thereby fully locking said female housing and said male housing fully locked together when fully assembled.

12. A method for improving clearance and creepage in a low profile high voltage connector, comprising the steps of:

inserting at least an electrical wire or cable into a female housing of said low profile high voltage connector, said female housing having a plurality of alley portions therein;

locking said electrical wire or cable inside said female housing of said low profile high voltage connector;

inserting a terminal position assurance (TPA) device through at least an opening of said female housing, and further inserting said TPA device into said female housing at a full-lock position within said female housing, said TPA device having a substantially elongated member extending therealong, wherein said step of further inserting said TPA device into said female housing at said full-lock position comprises a step of blocking each of said wire core portions of said plurality of electrical wires or cables from being removed or dislodged away from said female housing, said TPA device having a plurality of wall members extending therefrom, and each of said plurality of wall members of said TPA device being accommodated within a corresponding one of said plurality of alley portions of said female housing;

providing said low profile high voltage connector with a male housing, said male housing accommodating therein said female housing; and allowing a clearance or electrical path to extend from said at least electrical wire or cable to said female housing, wherein said step of allowing said clearance or electrical path comprises a step of extending said clearance or electrical path from at least said electrical wire or cable along a surface of at least one of said plurality of wall members of said TPA device to said female housing having at least one of said alley portions which accommodates therein said at least one of said wall members, said clearance or electrical path further extending along said substantially elongated member of said TPA device, thereby extending the clearance or electrical path between electrical wires or cables inserted within said female housing and further preventing said electrical path from traveling or traversing the top portion of said TPA device.

13. The method for improving clearance and creepage in said low profile high voltage connector according to claim 12, wherein said step of allowing said clearance or electrical path comprises a step of extending said clearance or electrical path substantially vertically from at least said electrical wire or cable to said female housing.

14. A low profile high voltage connector, comprising:

a male housing having a plurality of pins inserted therein, said male housing further having a lock member;

a female housing having a plurality of electrical wires or cables inserted therein, said female housing having a first ramp member and a second ramp member therein, said first ramp member being located at a first portion of said female housing, while said second ramp member being located at a second portion of said female housing;

a terminal position assurance (TPA) device insertable into said female housing for locking said plurality of wires or cables inside said female housing, said TPA device insertable into said female housing at one of a pre-lock position and a full-lock position; and a connector position assurance (CPA) device insertable into said female housing for locking said male housing and said female housing together, said CPA device insertable into said female housing at one of a pre-lock position and a full-lock position, wherein said CPA device comprises a centrally located flexible member, wherein said CPA device comprises a lock member at an end thereof, wherein said CPA device further comprises a head member, and a front member connected to side members, said front member being at an opposite side of said head member, wherein said front member of said CPA device travels along said first ramp member of said female housing when said CPA device is positioned in a pre-lock position, wherein when said CPA device is positioned in a full-lock position, said male housing and said female housing become fully mated, and said second ramp member of said female housing blocks said lock member of said male housing thereby said female housing is unable to be dislodged or removed from said male housing, and wherein said ramp member resting between said lock member of said male housing and said lock member of said CPA device.

* * * * *